US006780577B2

(12) United States Patent
Furuuchi

(10) Patent No.: US 6,780,577 B2
(45) Date of Patent: Aug. 24, 2004

(54) SILVER HALIDE PHOTOGRAPHIC MATERIAL

(75) Inventor: Hideo Furuuchi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/266,586

(22) Filed: Oct. 9, 2002

(65) Prior Publication Data

US 2003/0170575 A1 Sep. 11, 2003

(30) Foreign Application Priority Data

Oct. 11, 2001 (JP) ..... P 2001-313986

(51) Int. Cl.[7] ..... G03C 1/005; G03C 1/494

(52) U.S. Cl. ..... 430/572; 430/570; 430/573; 430/574; 430/575; 430/576; 430/581; 430/599; 430/600

(58) Field of Search ..... 430/570, 581, 430/599, 600, 572–576

(56) References Cited

U.S. PATENT DOCUMENTS 3,622,316 A 11/1971 Bird
6,117,629 A * 9/2000 Yamashita et al. ..... 430/570
6,165,703 A * 12/2000 Parton et al. ..... 430/572
6,180,332 B1 * 1/2001 Yamashita et al. ..... 430/574
6,537,742 B2 * 3/2003 Yamashita et al. ..... 430/574

FOREIGN PATENT DOCUMENTS

EP 1 061 411 12/2000
EP 1 199 595 4/2002

* cited by examiner

*Primary Examiner*—Geraldine Letscher
(74) *Attorney, Agent, or Firm*—Sughrue Mion, PLLC

(57) ABSTRACT

A silver halide photographic material containing silver halide grains onto which a sensitizing dye in the first layer and a sensitizing dye or dyes in the second or after layers are multilayer-adsorbed, wherein the fluorescence life time of the dye or dyes in the second or after layers on the silver halide grain surface measured at a maximum wavelength of fluorescence spectrum is shorter than the fluorescence life time of the dye or dyes in a gelatin dry film measured at a maximum wavelength of fluorescence spectrum when the sensitizing dyes are multilayer-adsorbed onto the silver halide grain surface.

18 Claims, No Drawings

SILVER HALIDE PHOTOGRAPHIC MATERIAL

FIELD OF THE INVENTION

The present invention relates to a photographic material in which a spectrally sensitized silver halide photographic emulsion is used.

BACKGROUND OF THE INVENTION

A great endeavor has been tried for increasing the sensitivity of a silver halide photographic material. In a silver halide photographic emulsion, a sensitizing dye adsorbed onto the surface of a silver halide grain absorbs rays of light incident on the photographic material and transmits the light energy to the silver halide grain, thereby sensitivity can be obtained. It is thought, accordingly, that the light energy transmitted to a silver halide can be increased by increasing the light absorption rate per the unit surface area of a silver halide grain in the spectral sensitization of silver halide, as a result, the enhancement of spectral sensitivity can be attained. It is preferred to increase the adsorption amount of a spectral sensitizing dye per the unit surface area of a silver halide grain for improving the light absorption rate of the surface of the silver halide grain.

However, there is a limit in the adsorption amount of a sensitizing dye onto the surface of a silver halide grain, and it is difficult to adsorb the dye chromophore of the amount more than the amount by a monolayer saturation adsorption (i.e., the adsorption by a single layer) onto a silver halide grain. Accordingly, the absorption rate of the incident light quantum of each silver halide grain in the spectral sensitization region is still low in the present situation.

The means suggested to solve these points will be described below.

P. B. Gilman, Jr. et al. tried to adsorb a cationic dye onto the first layer (of a silver halide grain) and an anionic dye onto the second layer by electrostatic force as described in *Photographic Science and Engineering*, Vol. 20, No. 3, page 97 (1976).

G. B. Bird et al. tried to multilayer-adsorb a plurality of dyes onto silver halide to effect sensitization by virtue of the transfer of Forster type excitation energy in U.S. Pat. No. 3,622,316.

Sugimoto et al. performed spectral sensitization due to energy transfer from a luminescent dye as disclosed in JP-A-63-138341 and JP-A-64-84244 (the term "JP-A" as used herein means an "unexamined published Japanese patent application").

R. Steiger et al. tried spectral sensitization due to energy transfer from a gelatin-substituted cyanine dye in *Photographic Science and Engineering*, Vol. 27, No. 2, page 59 (1983).

Ikekawa et al. performed spectral sensitization due to energy transfer from a cyclodextrin-substituted dye in JP-A-61-251842.

Richard Parton et al. tried multilayer-adsorption using a cationic dye and an anionic dye in combination to increase sensitivity by virtue of the transfer of energy from the dye in the second layer to the dye in the first layer as disclosed in EP-A-0985964, EP-A-0985965, EP-A-0985966 and EP-A-0985965.

However, these techniques could not bring about multilayer-adsorption of sensitizing dyes onto the surface of a silver halide grain in a sufficient degree in practice, and so the improving effect of sensitivity was extremely small.

Yamashita et al. realized an increase in sensitivity by virtue of multilayer-adsorption by a cationic dye and an anionic dye having an aromatic group in JP-A-10-239789.

So-called connected dyes having two chromophores which are not conjugated separately and connected by a covalent bond are prospective for the purpose of efficiently transmitting light absorption energy to silver halide to thereby increase sensitivity and for the purpose of raising the stability of the dye in the second layer, since the dye moiety which is not adsorbed onto the silver halide and the dye moiety adsorbed onto the silver halide can be approached by the covalent bond.

Connected dyes are disclosed, e.g., in U.S. Pat. Nos. 2,393,351, 2,425,772, 2,518,732, 2,521,944, 2,592,196 and EP 565083. However, these dyes were not dyes aiming at the improvement of light absorption rate. As the dyes aiming at the improvement of light absorption rate actively, G. B. Bird, A. L. Borror et al. contrived to increase sensitivity in U.S. Pat. Nos. 3,622,317 and 3,976,493 by virtue of energy transfer by adsorbing connecting type sensitizing dye molecules having a plurality of cyanine chromophores onto silver halide to thereby heighten the light absorption rate. Ukai, Okazaki and Sugimoto proposed in JP-A-64-91134 to bond at least one substantially non-adsorptive cyanine, merocyanine or hemicyanine dye containing at least two sulfo groups and/or carboxyl groups to a spectral sensitizing dye adsorptive onto silver halide.

L. C. Vishwakarma showed a method of synthesizing a connected dye by a dehydration condensation reaction of two dyes in JP-A-6-57235. Further, L. C. Vishwakarma showed in JP-A-6-27578 that a connected dye comprising monomethine cyanine and pentamethine oxonol had red-sensitivity, but spectral sensitization by virtue of the transfer of Forster type excitation energy between the dyes was not effected in this case because the emission of the oxonol dye did not overlap the absorption of the cyanine dye. Therefore, an increase in sensitivity by the light converging function of the connected oxonol cannot be obtained.

R. L. Parton et al. reported in EP-A-887770 the enhancement of sensitivity by a compound comprising a merocyanine dye connected with a cyanine dye by a linking group containing a hetero atom, but the effect of improving light absorption was not sufficient.

M. R. Roberts et al. suggested spectral sensitization by a cyanine dye polymer in U.S. Pat. No. 4,950,587.

In the above-described multilayer adsorption systems, dye chromophores were selected so that the emission spectrum of the second layer and the absorption spectrum of the first layer overlapped each other for the purpose of rapidly bringing about Forster type energy transfer from the second layer to the first layer. (*Th. Forster, Discuss. Faraday Soc.*, 27, 7, (1959).)

However, the intended sensitivity improving effect could not be obtained in practice, even in multilayer adsorption systems wherein Forster type energy transfer is capable of being brought about in theory.

As a result of eager investigation, the present inventors have found that sensitivity can be improved so long as the duration of life of excitation state of the dye in the second layer of the multilayer adsorption system is long, or the emission velocity of the dye in the second layer is great, even if the condition is not such that the emission spectrum of the second layer and the absorption spectrum of the first layer overlap each other under which Forster type energy transfer is conventionally thought to be liable to take place. That is, it has been found that higher sensitization can be realized even if Forster type energy transfer does not take place.

SUMMARY OF THE INVENTION

An object of the present invention is to provide a silver halide photographic emulsion which is highly sensitized by multilayer adsorption of sensitizing dyes selected by reflecting the nature of excitation state directly observed.

The above object of the present invention can be attained by the following means.

(1) A silver halide photographic material containing silver halide grains onto which a sensitizing dye in the first layer and a sensitizing dye or dyes in the second or after layers are multilayer-adsorbed, wherein the fluorescence life time of the dye or dyes in the second or after layers on the silver halide grain surface measured at a maximum wavelength of fluorescence spectrum is shorter than the fluorescence life time of the dye or dyes in a gelatin dry film measured at a maximum wavelength of fluorescence spectrum.

(2) A silver halide photographic material containing silver halide grains onto which a sensitizing dye in the first layer and a sensitizing dye or dyes in the second or after layer are multilayer-adsorbed, wherein the value obtained by dividing the fluorescence yield of the dye or dyes in the second or after layers measured in a gelatin dry film by the fluorescence life time of the dye or dyes measured in a gelatin dry film at a maximum wavelength of fluorescence spectrum (a velocity constant of radiation deactivation) is $10^7$ $sec^{-1}$ or higher.

(3) The silver halide photographic material containing silver halide grains onto which sensitizing dyes are multilayer-adsorbed as described in the above item (2), wherein the fluorescence yield of the dyes in the second or after layers in gelatin is 1% or higher.

(4) The silver halide photographic material as described in the above item (1), (2) or (3), wherein the fluorescence yield of the dyes in the second or after layers in gelatin is greater than the emission yield of the sensitizing dyes multilayer-adsorbed onto the silver halide grains.

(5) The silver halide photographic material containing silver halide grains onto which sensitizing dyes are multilayer-adsorbed as described in the above item (1), (2), (3) or (4), wherein the yield of nonradiative deactivation process of the dyes in the second or after layers in gelatin is 50% or lower.

(6) The silver halide photographic material containing silver halide grains onto which sensitizing dyes are multilayer-adsorbed as described in the above item (1), (2), (3), (4) or (5), wherein the yield of nonradiative deactivation process of the sensitizing dyes multilayer-adsorbed onto the silver halide grains is 50% or lower.

(7) The silver halide photographic material containing silver halide grains onto which sensitizing dyes are multilayer-adsorbed as described in the above item (1), (2), (3), (4), (5) or (6), wherein the distance between the dye in the second layer and the dye in the first layer is 50 angstroms or less.

(8) The silver halide photographic material as described in any of the above items (1) to (7), wherein the photographic material contains silver halide grains having a spectral absorption maximum wavelength of less than 500 nm and light absorption intensity of 60 or more, or a spectral absorption maximum wavelength of 500 nm or more and light absorption intensity of 100 or more.

(9) The silver halide photographic material as described in any of the above items (1) to (8), wherein when the maximum value of the spectral absorption rate of the silver halide grain by virtue of the sensitizing dye is taken as Amax, the wavelength distance between the shortest wavelength and the longest wavelength showing 50% of Amax is 120 nm or less.

(10) The silver halide photographic material as described in any of the above items (1) to (9), wherein when the maximum value of the spectral sensitivity of the silver halide grain by virtue of the sensitizing dye is taken as Smax, the wavelength distance between the shortest wavelength and the longest wavelength showing 50% of Smax is 120 nm or less.

(11) The silver halide photographic material as described in any of the above items (1) to (10), wherein when the maximum value of the spectral absorption rate of the silver halide grain by virtue of the dye chromophore in the first layer is taken as A1max, the maximum value of the spectral absorption rate by virtue of the dye chromophores in the second or after layers is taken as A2max, and the maximum value of the spectral sensitivity of the silver halide grain by virtue of the dye chromophore in the first layer is taken as S1max, and the maximum value of the spectral sensitivity by virtue of the dye chromophores in the second or after layers is taken as S2max, A1max and A2max, or S1max and S2max is from 400 to 500 nm or from 500 to 600 nm, or from 600 to 700 nm or from 700 to 1,000 nm.

(12) The silver halide photographic material as described in any of the above items (1) to (11), wherein the longest wavelength showing the spectral absorption rate of 50% of Amax or Smax is from 460 to 510 nm, or from 560 to 610 nm, or from 640 to 730 nm.

(13) The silver halide photographic material as described in any of the above items (1) to (12), wherein the excitation energy of the dye chromophores in the second or after layers of the silver halide grain transfers to the dye chromophore in the first layer in an efficiency of 10% or more.

(14) The silver halide photographic material as described in any of the above items (1) to (13), wherein the dye chromophore in the first layer and the dye chromophores in the second or after layers of the silver halide grains both show J-band absorption.

(15) The silver halide photographic material as described in any of the above items (1) to (14), wherein the dye in the first layer and the dyes in the second or after layers are connected by a covalent bond.

(16) The silver halide photographic material as described in the above item (15), wherein the covalent bond which connects the dyes in the second or after layers and the dye in the first layer comprises an organic bonding group containing one or more hetero atoms which are not a part of an amido group or an ester group.

(17) The silver halide photographic material as described in any of the above items (1) to (16), wherein the silver halide photographic emulsion in the photographic material is an emulsion wherein tabular grains having an aspect ratio of 2 or higher account for 50% or more of all area of the silver halide grains in the emulsion.

(18) The silver halide photographic material as described in any of the above items (1) to (17), wherein the silver halide photographic emulsion contained in the photographic material has been selenium-sensitized.

(19) The silver halide photographic material as described in any of the above items (1) to (18), wherein the silver halide grains in the silver halide photographic material contain a compound adsorptive onto silver halide other than the sensitizing dye.

DETAILED DESCRIPTION OF THE INVENTION

The present invention is described in detail below.

The present invention relates to a silver halide photographic material of high sensitivity onto which sensitizing dyes selected by directly observing the nature of excitation state are multilayer-adsorbed.

"Multilayer adsorption" used in the present invention is the state of a dye chromophore being adsorbed onto a grain surface in one or more layers, which means that one or more layers of a dye restricted to the vicinity of a silver halide grain are present, and the dye in a dispersion medium is not included. In this case, the adsorption amount of a dye chromophore per the unit surface area of a grain is greater than the saturation covering amount by one layer. The saturation covering amount by one layer used here means the dye adsorption amount per the unit surface area at the time of saturation covering by one layer.

The chromophore described herein means an atomic group which is a main cause of absorption band of a molecule as described in *Rikagaku Jiten* (*Physicochemical Thesaurus*), 4th Ed., pp. 985 to 986, Iwanami Shoten Co., Ltd. (1987), e.g., an atomic group having an unsaturated bond such as C═C or N═N, and any atomic groups may be used as the chromophore.

The examples of such chromophores include a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, an azamethine dye, a coumarin dye, an arylidene dye, an anthraquinone dye, a triphenylmethane dye, an azo dye, an azomethine dye, a spiro compound, a metallocene dye, a fluorenone dye, a fulgide dye, a perylene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperylene dye, a porphyrin dye, a chlorophyll dye, a phthalocyanine dye, and a metallic complex dye can be exemplified.

Of these chromophores, polymethine chromophores, e.g., a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, and an azamethine dye are preferred, a cyanine dye, a merocyanine dye, a trinuclear merocyanine dye, a tetranuclear merocyanine dye, and a rhodacyanine dye are more preferred, a cyanine dye, a merocyanine dye, and a rhodacyanine dye are still more preferred, and a cyanine dye is most preferred.

These dyes are described in detail in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chapter 18, Clause 14, pages 482 to 515. As the preferred formulae of the dyes, the formulae on pages 32 to 36 in U.S. Pat. No. 5,994,051, and the formulae on pages 30 to 34 in U.S. Pat. No. 5,747,236 can be exemplified. Further, the formulae (XI), (XII) and (XIII), columns 21 and 22 in U.S. Pat. No. 5,340,694 can be exemplified as the preferred formulae of cyanine, merocyanine and rhodacyanine dyes, respectively (however, the numbers of $n_{12}$, $n_{15}$, $n_{17}$ and $n_{19}$ are not restricted here and regarded as the integers of 0 or more (preferably 4 or less)).

The layer number of adsorption of a dye chromophore onto silver halide grains is preferably 1.5 layers or more, more preferably 1.7 layers or more, and particularly preferably 2 layers or more. The upper limit of the number of layers is not particularly limited but is preferably 10 layers or less, more preferably 5 layers or less.

For confirming the state of multilayer adsorption, when the saturation adsorption amount per unit surface area achieved by a dye having the smallest dye occupation area on a silver halide grain surface, i.e., the area which is occupied by one molecule of a dye, of the dyes added to the emulsion, is taken as the saturation covering amount by one layer, the state of multilayer adsorption can be confirmed by obtaining the adsorption amount per the unit area of the dye chromophore, i.e., the adsorption layer number, with the saturation covering amount by one layer being the standard. In the case of a dye comprising dye chromophores combined by covalent bonding, the dye occupation area of each dye in the state of not being combined can be made standard.

The dye occupation area can be obtained from the adsorption isothermal line showing the relationship between a free dye concentration and an adsorption dye amount and the surface area of a grain. The adsorption isothermal line can be found by referring to, e.g., A. Herz et al., *Adsorption from Aqueous Solution* in Advances in Chemistry Series, No. 17, p. 173 (1968), for instance.

The amount of a sensitizing dye adsorbed onto emulsion grains can be obtained by centrifuging the emulsion onto which a dye is adsorbed, drying the emulsion grains separated from a supernatant gelatin aqueous solution, dissolving a specific weight of the precipitate in a 1/1 mixed solution of an aqueous sodium thiosulfate solution and methanol, and then measuring spectral absorption. When a plurality of sensitizing dyes are used, the adsorption amount of each dye can be found, e.g., by high speed liquid chromatography.

As one example of measuring methods of the surface area of a silver halide grain, a method of obtaining a figure and size of individual grain from a transmission electromicrophotograph by a replica method is available. In this case, the thickness of a tabular grain is calculated from the length of the shadow of a replica. As for the photographing method of a transmission electromicrophotograph, e.g., compiled by Nippon Denshi Kenbikyo Gakkai Kanto Branch, *Denshi Kenbikyo Shiryo Gijutsu-Shu* (*Techniques on Electromicrophotographic Samples*), published by Seibundo Shinkosha Co., Ltd. (1970) and P. B. Hirsch et al., *Electron Microscopy of Thin Crystals*, Butterworths, London (1965) can be referred to.

As other methods, e.g., A. M. Kragin et al., *The Journal of Photographic Science*, Vol. 14, p. 185 (1966), J. F. Paddy, *Transactions of the Faraday Society*, Vol. 60, p. 1325 (1964), S. Boyer et al., *Journal de Chimie Physique et de Physicochimie Biologique*, Vol. 63, p. 1123 (1963), W. West et al., *Journal of Physical Chemistry*, Vol. 56, p. 1054 (1952), compiled by H. Sauvenier, E. Klein et al., *International Colloquium*, Liege (1959), and *Scientific Photography* can be referred to.

The dye occupation area can be obtained by the above methods as to individual case experimentally, but since the molecule occupation area of generally used sensitizing dyes is about 80 $Å^2$, adsorption layer number can be estimated roughly with taking the dye occupation area of all the dyes as 80 $Å^2$ for convenience' sake.

The dye in the first layer described below means dye chromophores (directly adsorbed onto a silver halide grain surface) showing the adsorption amount of the saturation covering amount by one layer or less, and the dye in the second layer means dye chromophores not directly adsorbed onto a silver halide grain surface among dye chromophores showing the adsorption amount of more than the saturation covering amount by one layer and two times that or less.

In a multilayer adsorption system, it is necessary that spectral sensitization should be caused by the dye not directly adsorbed onto a silver halide grain surface, and regarding the spectral sensitization by the dyes in the second or after layers, the spectral sensitization is largely influenced by the nature of the excitation state of the second or after layers. In particular, the duration of life of the excitation state of the dyes in the second or after layers largely affects the spectral sensitization, and the duration of life of excitation state of the dyes in the second or after layers alone must be longer than that of the dyes in the second or after layers multilayer-adsorbed onto the emulsion grain surface.

For obtaining efficient spectral sensitization by virtue of the dyes in the second or after layers, the velocity constant of radiation deactivation of the dyes in the second or after layers is preferably large. The velocity constant of radiation deactivation of the dyes in the second or after layers is preferably $10^7$ $sec^{-1}$ or higher (and $10^{13}$ $sec^{-1}$ or lower), and more preferably $10^8$ $sec^{-1}$ or higher. The velocity constant of radiation deactivation can be obtained by dividing the fluorescence yield (quantum yield of emission) by the duration of life of excitation state.

The quantum yield of emission can be measured according to the method disclosed in JP-A-63-138341.

The method is described below.

The quantum yield of emission of a dye in a dry film can be measured fundamentally according to the same method as in the case of the quantum yield of emission of a solution, i.e., it can be generally obtained according to a relative measuring method of comparing incident light intensity and the emission intensity of a sample under constant optical arrangement, with a standard sample whose absolute quantum yield is already known (e.g., Rhodamine B, quinine sulfate, 9,10-diphenylanthracene) as reference. With respect to this relative measuring method, e.g., C. A. Parker and W. T. Rees, *Analyst*, Vol. 85, p. 587 (1960) can be referred to.

Accordingly, the quantum yield of emission of a dye in a dry gelatin defined in the present invention can be easily obtained by the above relative measuring method, with dry gelatin whose absolute quantum yield is already known having dispersed therein a standard luminescent dye of ordinary concentration as a standard. The present inventors obtained the absolute quantum yield of emission of a standard sample in a dry film according to the following manner.

Fluorescent N-phenyl-1-naphthylamine-8-sulfonic acid not having contribution of reabsorption due to overlap of an absorption band and an emission band was selected as a standard dye, and gelatin containing the dye was uniformly coated on a transparent support and dried in dye concentration in the dry film of $10^{-3}$ $mol/dm^3$, coated gelatin weight of 6 $g/m^2$, thus a standard sample was obtained. Subsequently, the sample was set in an integrating sphere coated with a white powder ($BaSO_4$) on the inwall, irradiated with a monochromatic excitation light of 380 nm, and the intensities of excitation light and fluorescence were detected with a photomultiplier attached on the window of the integrating sphere. At this time, a fluorescence-cutting filter was attached to the photomultiplier and light absorption rate A of the sample was measured by comparing the intensities of the excitation light in the cases of setting the sample and not setting the sample. After the integrated intensity of fluorescence F and the incident monochromatic intensity I measured in the same measuring system as F without the sample and the filter were converted to the forms of net photon number F and I on the basis of the spectral transmittance of an excitation light-cutting filter, the effective spectral reflectance of the integrating sphere, and the spectral sensitivity of the photomultiplier, the absolute quantum yield of fluorescence was computed from F/(I·A).

The quantum yield of fluorescence of various dyes in a gelatin dry film can be obtained from relative measurement of the quantum yield of emission on the basis of the thus-obtained standard sample whose absolute quantum yield of fluorescence is already known.

The duration of life of the excitation state of a dye can be measured according to the method described in Tadaaki Tani, Takeshi Suzumoto, Klaus Kemnitz, Keitaro Yoshihara, *The Journal of Physical Chemistry*, Vol. 96, p. 2778 (1992).

A velocity constant of radiation deactivation can be obtained from the quantum yield of emission and the duration of life of the excitation state of a dye.

For obtaining efficient spectral sensitization by virtue of the dyes in the second or after layers, the quantum yield of nonradiative deactivation of the dyes in the second or after layers is preferably small.

The quantum yield of nonradiative deactivation of the dyes in the second or after layers is preferably 0.5 or less, more preferably 0.2 or less, and most preferably 0.1 or less.

For obtaining efficient spectral sensitization by virtue of the dyes in the second or after layers, the distance between the dye in the second layer and the dye in the first layer is preferably 50 angstroms or less, more preferably 40 angstroms or less, still more preferably 30 angstroms or less, and most preferably 20 angstroms or less.

Luminescent dyes are preferably used as the dyes in the second or after layers, and the fluorescence yield of the dyes is preferably 1% or higher, and more preferably 10% or higher.

The dye in the first layer forms J-aggregate, and further, it is preferred for the dyes in the second or after layers to form J-aggregate, too, for the purpose of obtaining absorption and spectral sensitivity in a desired wavelength range. Since J-aggregate has great emission velocity, this is preferred for the dyes in the second or after layers to cause spectral sensitivity.

For efficiently catching an incident light, it is necessary that the absorption coefficient of the dye in the first layer should be high. The absorption coefficient of the dyes in the second or after layers measured in methanol is preferably $1\times10^4$ $M^{-1}$ $cm^{-1}$ or higher, more preferably $3\times10^4$ $M^{-1}$ $cm^{-1}$ or higher, still more preferably $5\times10^4$ $M^{-1}$ $cm^{-1}$ or higher, still further more preferably $8\times10^4$ $M^{-1}$ $cm^{-1}$ or higher, and most preferably $10\times10^4$ $M^{-1}$ $cm^{-1}$ or higher.

When dye chromophores are multilayer-adsorbed onto silver halide grains in the present invention, the reduction potentials and oxidation potentials of the dye chromophore in the so-called first layer which is directly adsorbed onto the silver halide grains, and the dye chromophores in the second or after layers are not particularly restricted, but it is preferred that the value of the reduction potential of the dye chromophore of the first layer is more positive than the value obtained by subtracting 0.2 V from the value of the reduction potential of the dye chromophores in the second or after layers.

Reduction potential and oxidation potential can be measured by various methods but a measuring method by phase discriminating second harmonic AC polarography is preferred, by which a correct value can be obtained. The measuring method of potentials according to phase discriminating second harmonic AC polarography is described in *Journal of Imaging Science*, Vol. 30, p. 27 (1986).

It is preferred that the silver halide photographic emulsions according to the present invention contain silver halide grains having the light absorption intensity of 100 or more in the proportion of ½ or more of the entire projected area of silver halide grains when the spectral absorption maximum wavelength exceeds 500 nm, and silver halide grains having the light absorption intensity of 60 or more in the proportion of ½ or more of the entire projected area of silver halide grains when the spectral absorption maximum wavelength is 500 nm or less. Further, when the spectral absorption maximum wavelength of the grains exceeds 500 nm, the light absorption intensity is preferably 150 or more, more preferably 170 or more, and particularly preferably 200 or more, and when the spectral absorption maximum wavelength of the grains is 500 nm or less, the light absorption intensity is preferably 90 or more, more preferably 100 or more, and particularly preferably 120 or more. The upper limit of the light absorption intensity is not particularly restricted but is preferably 2,000 or less; more preferably 1,000 or less, and particularly preferably 500 or less.

With respect to the grains having the spectral absorption maximum wavelength of 500 nm or less, the spectral absorption maximum wavelength is preferably 350 nm or more.

In the present invention, light absorption intensity means the light absorption integrated intensity per a unit surface area of a grain by a sensitizing dye, and is defined as the value obtained by integrating optical density Log $(I_0/(I_0-I))$ to wavelength ($cm^{-1}$), when the light amount to be incident on the unit surface area of a grain is taken as $I_0$ and the light amount to be absorbed by a sensitizing dye on the surface is taken as I. The coverage of integration is from 5,000 $cm^{-1}$ to 35,000 $cm^{-1}$.

As one example of measuring the light absorption intensity, a method of using a microspectrophotometer can be exemplified. A microspectrophotometer is an apparatus capable of measuring the absorption spectrum of a minute area, and it is possible to measure the transmission spectrum of one grain with the apparatus. Regarding the measurement of the absorption spectrum of one grain by a micro-spectral method, Yamashita et al., *The Substances of the Lectures in Annual Meeting in* 1996, Nippon Shashin Gakkai, p. 15 can be referred to. The absorption intensity per one grain can be obtained from the absorption spectrum. As the light which transmits a grain is absorbed at two planes of an upper plane and a lower plane, the light absorption intensity per a unit area of a grain surface can be obtained as ½ of the absorption intensity per one grain obtained by the above method. The coverage of the integration of absorption spectrum at this time is from 5,000 $cm^{-1}$ to 35,000 $cm^{-1}$ in the definition of light absorption intensity, but in view of experiment the coverage of the integration may be the coverage including 500 $cm^{-1}$ before and behind the region where a sensitizing dye has absorption.

The light absorption intensity is a value determined univocally by the oscillator intensity of a sensitizing dye and the ad-molecule number per a unit area, hence the light absorption intensity is convertible from the oscillator intensity of a sensitizing dye, the adsorption amount of a dye and the surface area of a grain.

As the oscillator intensity of a sensitizing dye can be obtained experimentally as a value proportional to the absorption integrated intensity of a sensitizing dye solution (optical density×$cm^{-1}$), the light absorption intensity can be obtained according to the following equation with the errors of about 10% with taking the absorption integrated intensity of a sensitizing dye per 1 M as A (optical density×$cm^{-1}$), the adsorption amount of the sensitizing dye as B (mol/mol Ag), and the surface area of the grain as C ($m^2$/mol of Ag):

$$0.156 \times A \times B/C$$

The light absorption intensity found from the above equation is substantially the same as the value obtained by integrating the light absorption intensity measured according to the above definition [Log $(I_0/(I_0-I))$] to wavelength ($cm^{-1}$).

The distance between the shortest wavelength and the longest wavelength respectively showing 50% of the maximum value of spectral absorption rate Amax and the maximum value of spectral sensitivity Smax by a sensitizing dye of the emulsion containing silver halide photographic emulsion grain having light absorption intensity of 60 nm or more or 100 or more is preferably 120 nm or less, and more preferably 100 nm or less.

The distance between the shortest wavelength and the longest wavelength respectively showing 80% of Amax and Smax is 20 nm or more, and preferably 100 nm or less, more preferably 80 nm or less, and most preferably 50 nm or less.

The distance between the shortest wavelength and the longest wavelength respectively showing 20% of Amax and Smax is preferably 180 nm or less, more preferably 150 nm or less, particularly preferably 120 nm or less, and most preferably 100 nm or less.

The longest wavelength showing the spectral absorption rate of 50% of Amax or Smax is preferably from 460 nm to 510 nm, or from 560 nm to 610 nm, or from 640 nm to 730 nm.

A preferred first method of realizing a silver halide grain the surface of which is multilayer-adsorbed with sensitizing dyes having a great radiation deactivation velocity of the dyes in the second or after layers is to use the specific dyes as shown below.

As the dyes for use in the first layer, dyes having at least one aromatic group are preferably used.

Aromatic groups are described in detail below. As aromatic groups, there are exemplified hydrocarbon aromatic groups and heterocyclic aromatic groups. These aromatic groups may further be polycyclic condensed rings obtained by condensation of hydrocarbon aromatic rings and heterocyclic aromatic rings, or they maybe groups having polycyclic condensed ring structures comprising hydrocarbon aromatic rings and heterocyclic aromatic rings in combination, and they may be substituted with the later-described substituents V and the like. The examples of aromatic rings contained in the aromatic groups include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, carbazole, phenanthridine, acridine, phenanthroline, thianthrene, chromene, xanthene, phenoxathine, phenothiazine and phenazine.

More preferred aromatic groups are the above hydrocarbon aromatic rings, and benzene and naphthalene are particularly preferred, and benzene is most preferred.

As the dyes, the dyes exemplified above as the examples of dye chromophores are included, and preferably the dyes described above as the examples of polymethine dye chromophores are exemplified. Particularly preferred methods are described below with reference to formulae.

(I)

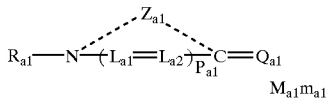

wherein $Z_{a1}$ represents an atomic group necessary to form a nitrogen-containing heterocyclic ring, and a ring may be condensed with $Z_{a1}$; $R_{a1}$ represents an alkyl group, an aryl group, or a heterocyclic group; $Q_{a1}$ represents a group necessary for a compound represented by formula (I) to form a methine dye; $L_{a1}$ and $L_{a2}$ each represents a methine group; and $p_{a1}$ represents 0 or 1; provided that $Z_{a1}$, $R_{a1}$, $Q_{a1}$, $L_{a1}$ and $L_{a2}$ each has a substituent so that a methine dye represented by formula (I) becomes a cationic dye, a betaine dye or a nonionic dye as a whole, however, when formula (I) is a cyanine dye or a rhodacyanine dyes $Z_{a1}$, $R_{a1}$, $Q_{a1}$, $L_{a1}$ and $L_{a2}$ each preferably has a substituent to become a cationic dye; $M_{a1}$ represents a counter ion for equilibrating a charge; and $m_{a1}$ represents a number of 0 or higher necessary for neutralizing a charge in the molecule.

(II)

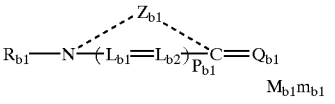

wherein $Z_{b1}$ represents an atomic group necessary to form a nitrogen-containing heterocyclic ring, and a ring may be condensed with $Z_{b1}$; $R_{b1}$ represents an alkyl group, an aryl group, or a heterocyclic group; $Q_{b1}$ represents a group necessary for a compound represented by formula (II) to form a methine dye; $L_{b1}$ and $L_{b2}$ each represents a methine group; and $p_{b1}$ represents 0 or 1; provided that $Z_{b1}$, $R_{b1}$, $Q_{b1}$, $L_{b1}$ and $L_{a2}$ each has a substituent so that a methine dye represented by formula (II) becomes an anionic dye as a whole; $M_{b1}$ represents a counter ion for equilibrating a charge; and $m_{b1}$ represents a number of 0 or higher necessary for neutralizing a charge in the molecule.

When a compound represented by formula (I) is used alone, $R_{a1}$ preferably represents a group having an aromatic ring.

When a compound represented by formula (I) and a compound represented by formula (II) are used in combination, at least one of $R_{a1}$ and $R_{b1}$ preferably represents a group having an aromatic ring.

More preferably, $R_{a1}$ and $R_{b1}$ both preferably represent a group having an aromatic ring.

As the cationic dyes for use in the present invention, any dyes can be used so long as the charge of the dyes is cationic after eliminating the counter ions, but the dyes not having an anionic substituent are preferably used. Further, any dyes can be used as the anionic dyes in the present invention so long as the charge of the dyes is anionic after eliminating the counter ions, but the dyes having one or more anionic substituents are preferably used. The betaine dyes in the present invention are dyes which have a charge in the molecule but form an inner salt, and the molecule does not have a charge as a whole. The nonionic dyes in the present invention are dyes not having a charge in the molecule at all.

The anionic substituents means substituents having a negative charge, e.g., proton-dissociating acid radicals which dissociate 90% or more of protons at pH 5 to 8, and the specific examples include, e.g., a sulfo group, a carboxyl group, a sulfato group, a phosphoric acid group, and a boric acid group. In addition to these groups, a —$CONHSO_2$— group (e.g., a sulfonylcarbamoyl group, a carbonylsulfamoyl group), a —CONHCO— group (e.g., a carbonylcarbamoyl group), an —$SO_2NHSO_2$— group (e.g., a sulfonylsulfamoyl group), and a phenolic hydroxyl group can be exemplified, which groups dissociate protons by the pKa of them and the ambient pH. Of these groups, a sulfo group, a carboxyl group, a —$CONHSO_2$— group, a —CONHCO— group, and an —$SO_2NHSO_2$— group are preferred.

There are cases where a —$CONHSO_2$— group, a —CONHCO— group, and an —$SO_2NHSO_2$— group do not dissociate protons according to the pKa of them and the ambient pH. In such cases, these groups are not included in the anionic substituents meant by the present invention. That is, when protons are not dissociated, e.g., a later-described dye represented by formula (I-1) can be regarded as a cationic dye, even when two these groups are substituted.

As the cationic substituents, a substituted or unsubstituted ammonium group and a pyridinium group are exemplified.

A dye represented by formula (I) is more preferably represented by the following formula (I-1), (I-2) or (I-3):

(I-1)

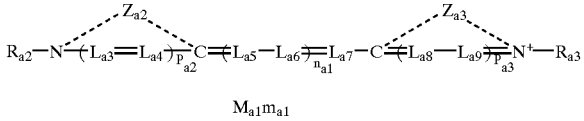

wherein $L_{a3}$, $L_{a4}$, $L_{a5}$, $L_{a6}$, $L_{a7}$, $L_{a8}$ and $L_{a9}$ each represents a methine group; $p_{a2}$ and $p_{a3}$ each represents 0 or 1; $n_{a1}$ represents 0, 1, 2, 3 or 4; $Z_{a2}$ and $Z_{a3}$ each represents an atomic group necessary to form a nitrogen-containing heterocyclic ring, and a ring may be condensed with $Z_{a2}$ and $Z_{a3}$; $R_{a2}$ and $R_{a3}$ each represents an alkyl group, an aryl group, or a heterocyclic group; and $M_{a1}$ and $m_{a1}$ each has the same meaning as in formula (I); provided that $R_{a2}$, $R_{a3}$, $Z_{a2}$, $Z_{a3}$, $L_{a3}$ to $L_{a9}$ each does not have an anionic substituent when formula (I-1) represents a cationic dye, and has one anionic substituent when (I-1) represents a betaine dye.

(I-2)

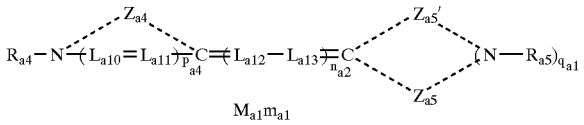

wherein $L_{a10}$, $L_{a11}$, $L_{a12}$ and $L_{a13}$ each represents a methine chain; $p_{a4}$ represents 0 or 1; $n_{a2}$ represents 0, 1, 2, 3 or 4; $Z_{a4}$ represents an atomic group necessary to form a nitrogen-containing heterocyclic ring; $Z_{a5}$ and $Z_{a5}'$ each represents an atomic group necessary to form a heterocyclic ring or an acyclic acidic terminal group together with $(N—R_{a5})_{qa1}$, and a ring may be condensed with $Z_{a4}$, and $Z_{a5}$ and $Z_{a5}'$; $R_{a4}$ and $R_{a5}$ each represents an alkyl group, an aryl group, or a heterocyclic group; and $M_{a1}$ and $m_{a1}$ each has the same meaning as in formula (I); provided that $R_{a4}$, $R_{a5}$, $Z_{a4}$, $Z_{a5}$, $L_{a10}$ to $L_{a13}$ each has a cationic substituent when formula (I-2) represents a cationic dye, has one cationic substituent and one anionic substituent when (I-2) represents a betaine dye, and does not have a nonionic substituent and an anionic substituent when (I-2) represents a nonionic dye.

(I-3)

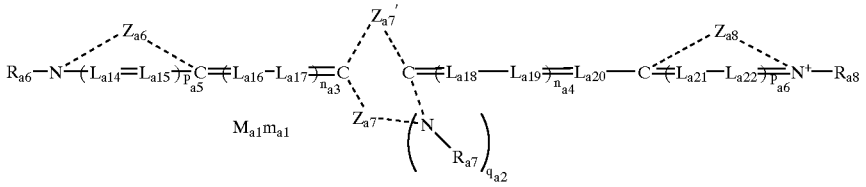

wherein $L_{a14}$, $L_{a15}$, $L_{a16}$, $L_{a17}$, $L_{a18}$ $L_{a19}$, $L_{a20}$, $L_{a21}$ and $L_{a22}$ each represents a methine group; $p_{a5}$ and $p_{a6}$ each represents 0 or 1; $q_{a2}$ represents 0 or 1; $n_{a3}$ and $n_{a4}$ each represents 0, 1, 2, 3 or 4; $Z_{a6}$ and $Z_{a8}$ each represents an atomic group necessary to form a nitrogen-containing heterocyclic ring; $Z_{a7}$ and $Z_{a7}'$ each represents an atomic group necessary to form a heterocyclic ring together with $(N—R_{a7})_{qa2}$, and a ring may be condensed with $Z_{a6}$, $Z_{a7}$ and $Z_{a7}'$, and $Z_{a8}$; $R_{a6}$, $R_{a7}$ and $R_{a8}$ each represents an alkyl group, an aryl group, or a heterocyclic group; and $M_{a1}$ and $m_{a1}$ each has the same meaning as in formula (I); provided that $R_{a6}$, $R_{a7}$, $R_{a8}$, $Z_{a6}$, $Z_{a7}$, $Z_{a8}$, $L_{a14}$ to $L_{a22}$ each does not have an anionic substituent when formula (I-3) represents a cationic dye, and has one anionic substituent when (I-3) represents a betaine dye.

An anionic dye represented by formula (II) is more preferably represented by the following formula (II-1), (II-2) or (II-3):

(II-1)

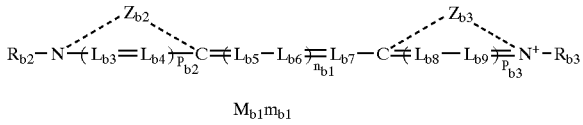

wherein $L_{b3}$, $L_{b4}$, $L_{b5}$, $L_{b6}$, $L_{b7}$, $L_{b8}$ and $L_{b9}$ each represents a methine group; $p_{b2}$ and $p_{b3}$ each represents 0 or 1; $n_{b1}$ represents 0, 1, 2, 3 or 4; $Z_{b2}$ and $Z_{b3}$ each represents an atomic group necessary to form a nitrogen-containing heterocyclic ring, and a ring may be condensed with $Z_{b2}$ and $Z_{b3}$; $R_{b2}$ and $R_{b3}$ each represents an alkyl group, an aryl group, or a heterocyclic group; and $M_{b1}$ and $m_{b1}$ each has the same meaning as in formula (II); provided that $R_{b2}$ and $R_{b3}$ each has an anionic substituent.

(II-2)

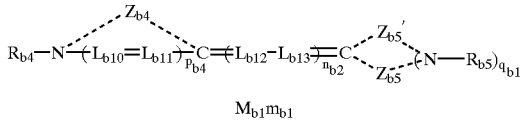

wherein $L_{b10}$, $L_{b11}$, $L_{b12}$ and $L_{b13}$ each represents a methine group; $p_{b4}$ represents 0 or 1; $q_{b1}$ represents 0 or 1; $n_{b2}$ represents 0, 1, 2, 3 or 4; $Z_{b4}$ represents an atomic group necessary to form a nitrogen-containing heterocyclic ring; $Z_{b5}$ and $Z_{b5}'$ each represents an atomic group necessary to form a heterocyclic ring or an acyclic acidic terminal group together with $(N—R_{b5})_{qb1}$, and a ring may be condensed with $Z_{b4}$, and $Z_{b5}$ and $Z_{b5}'$; $R_{b4}$ and $R_{b5}$ each represents an alkyl group, an aryl group, or a heterocyclic group; and $M_{b1}$ and $m_{b1}$ each has the same meaning as in formula (II); provided that at least one of $R_{b4}$ and $R_{b5}$ has an anionic substituent.

(II-3)

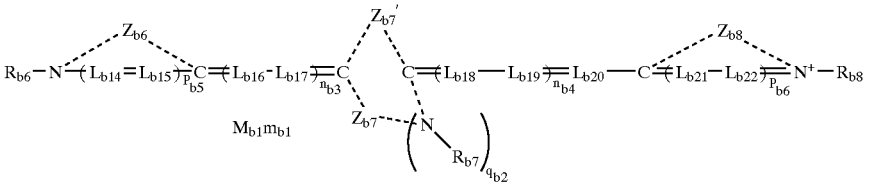

wherein $L_{b14}$, $L_{b15}$, $L_{b16}$, $L_{b17}$, $L_{b18}$, $L_{b19}$, $L_{b20}$, $L_{b21}$ and $L_{b22}$ each represents a methine group; $p_{b5}$ and $p_{b6}$ each represents 0 or 1; $q_{b2}$ represents 0 or 1; $n_{b3}$ and $n_{b4}$ each represents 0, 1, 2, 3 or 4; $Z_{b6}$ and $Z_{b8}$ each represents an atomic group necessary to form a nitrogen-containing heterocyclic ring; $Z_{b7}$ and $Z_{b7}'$ each represents an atomic group necessary to form a heterocyclic ring together with $(N—R_{b7})_{qb2}$, and a ring may be condensed with $Z_{b6}$, $Z_{b7}$ and $Z_{b7}'$, and $Z_{b8}$; $R_{b6}$, $R_{b7}$ and $R_{b8}$ each represents an alkyl group, an aryl group, or a heterocyclic group; and $M_{b1}$ and $m_{b1}$ each has the same meaning as in formula (II); provided that at least two of $R_{b6}$, $R_{b7}$ and $R_{b8}$ have an anionic substituent.

In formulae (I-1), (I-2) and (I-3), at least one of $R_{a2}$ and $R_{a3}$, and preferably both are groups having an aromatic ring, at least one of $R_{a4}$ and $R_{a5}$, and preferably both are groups having an aromatic ring, and at least one of $R_{a6}$, $R_{a7}$ and $R_{a8}$, preferably two, and still more preferably all of three are groups having an aromatic ring.

In formulae (II-1), (II-2) and (II-3), at least one of $R_{b2}$ and $R_{b3}$, and preferably both are groups having an aromatic ring, at least one of $R_{b4}$ and $R_{b5}$, and preferably both are groups having an aromatic ring, and at least one of $R_{b6}$, $R_{b7}$ and $R_{b8}$, preferably two, and still more preferably all of three are groups having an aromatic ring.

Any dyes can be used as the dye in the first layer, preferably a dye represented by formula (I) or (II), and more preferably a dye represented by formula (I) can be used.

When a dye represented by formula (I) or (II) is used as the dye in the first layer, $Z_{a1}$ and $Z_{b1}$ are preferably basic nuclei substituted with an aromatic group, or basic nuclei condensed with three or more rings.

As the dyes in the second or after layers, such compounds that a geometrical isomer relating to a methine chain does not isomerize in an excitation state can also be preferably used.

As the examples of such compounds methine compounds which are fixed so as to become all-trans structure by crosslinking methine chains are described below with referring to examples.

That is, a method of using a dye represented by formula (III) or (IV) in the second layer is described below.

(III)

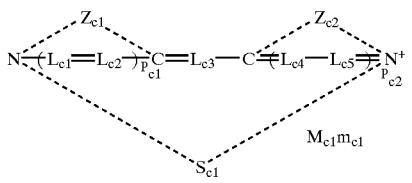

(IV)

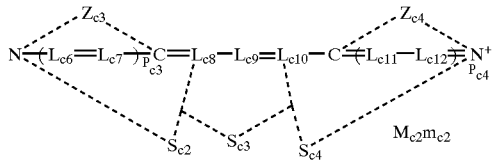

In formula (III), $L_{c1}$, $L_{c2}$, $L_{c3}$, $L_{c4}$ and $L_{c5}$ each represents a methine group; $S_{c1}$ represents a linking group; $Z_{c1}$ and $Z_{c2}$ each represents an atomic group necessary to form a 5- or 6-membered nitrogen-containing heterocyclic ring, and they may be further condensed; $p_{c1}$ and $p_{c2}$ each represents 0 or 1; $M_{c1}$ represents a counter ion for equilibrating a charge; and $m_{c1}$ represents a number of from 0 to 10 necessary to neutralize a charge in the molecule.

In formula (IV), $L_{c6}$, $L_{c7}$, $L_{c8}$, $L_{c9}$, $L_{c10}$, $L_{c11}$ and $L_{c12}$ each represents a methine group; $S_{c2}$, $S_{c3}$ and $S_{c4}$ each represents a linking group; $Z_{c3}$ and $Z_{c4}$ each represents an atomic group necessary to form a 5- or 6-membered nitrogen-containing heterocyclic ring, and they may be further condensed; $p_{c3}$ and $p_{c4}$ each represents 0 or 1; $M_{c2}$ represents a counter ion for equilibrating a charge; and $m_{c2}$ represents a number of from 0 to 10 necessary to neutralize a charge in the molecule.

In formulae (III) and (IV), a case where $Z_{c1}$, $Z_{c21}$ $Z_{c3}$ and $Z_{c4}$ are basic nuclei substituted with an aromatic group is preferred.

Aromatic groups are described in detail below. As aromatic groups, there are exemplified hydrocarbon aromatic groups and heterocyclic aromatic groups. These aromatic groups may further be polycyclic condensed rings obtained by condensation of hydrocarbon aromatic rings and heterocyclic aromatic rings, or they may be groups having polycyclic condensed ring structures comprising hydrocarbon aromatic rings and heterocyclic aromatic rings in combination, and they may be substituted with the later-described substituents V and the like. The examples of aromatic rings contained in the aromatic groups include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, carbazole, phenanthridine, acridine, phenanthroline, thianthrene, chromene, xanthene, phenoxathine, phenothiazine and phenazine.

More preferred aromatic groups are the above hydrocarbon aromatic rings, and benzene and naphthalene are particularly preferred, and benzene is most preferred.

$S_{c1}$, $S_{c2}$, $S_{c3}$ and $S_{c4}$ each represents a linking group. The linking group preferably comprises an atom or an atomic group containing at least one of a carbon atom, a nitrogen atom, a sulfur atom and an oxygen atom. The linking group is a linking group having from 0 to 100 carbon atoms, preferably from 1 to 20 carbon atoms, and preferably comprising in combination of one or more of an alkylene group (e.g., methylene, ethylene, propylene, butylene, pentylene), an arylene group (e.g., phenylene, naphthylene), an alkenylene group (e.g., ethenylene, propenylene), an alkynylene group (e.g., ethynylene, propynylene), an amido group, an ester group, a sulfonamido group, a sulfonate group, a ureido group, a sulfonyl group, a sulfinyl group, a thioether group, an ether group, a carbonyl group, —N(Va)— (Va represents a hydrogen atom or a monovalent substituent, as the monovalent substituent, the later-described V can be exemplified), and a heterocyclic divalent group (e.g., a 6-chloro-1,3,5-triazine-2,4-diyl group, a pyrimidine-2,4-diyl group, a quinoxaline-2,3-diyl group).

The linking group is more preferably a divalent linking group having from 1 to 20 carbon atoms comprising combination of one or more of an alkylene group having from 1 to 10 carbon atoms (e.g., methylene, ethylene, propylene, butylene), an arylene group having from 6 to 10 carbon atoms (e. g., phenylene, naphthylene), an alkenylene group having from 2 to 10 carbon atoms (e.g., ethenylene, propenylene), an alkynylene group having from 2 to 10 carbon atoms (e.g., ethynylene, propynylene), an ether group, an amido group, an ester group, a sulfonamido group, and a sulfonate group. These groups may be substituted with the later-described substituent V.

These linking groups may further have the later-described substituent V, or these linking groups may contain a ring (e.g., an aromatic or non-aromatic hydrocarbon ring, or a heterocyclic ring).

More preferably, these linking groups contain an aromatic group. As the aromatic group, the aromatic groups exemplified above as the substituents for the basic nuclei represented by $Z_{c1}$, $Z_{c2}$, $Z_{c3}$ and $Z_{c4}$ in formulae (III) and (IV) are used. The particularly preferred aromatic groups are benzene and naphthalene, and benzene is most preferred.

Another preferred method of realizing the adsorption state such that the surface of a silver halide grain is covered with dye chromophores by multilayer adsorption is to use a dye compound having two or more dye chromophore moieties linked by covalent bonding by a linking group. Any dye chromophores can be used but the above-described dye chromophores are exemplified. The above-described polymethine dye chromophores are preferred. A cyanine dye, a merocyanine dye, a rhodacyanine dye and an oxonol dye are more preferred, a cyanine dye, a rhodacyanine dye and a merocyanine dye are particularly preferred, and a cyanine dye is most preferred.

As the preferred examples, e.g., the methods of using a dye linked by a methine chain as disclosed in JP-A-9-265144, the methods of using a dye linked with an oxonol dye as disclosed in JP-A-10-226758, the methods of using a linked dye having a specific structure as disclosed in JP-A-

10-110107, JP-A-10-307358, JP-A-10-307359 and JP-A-10-310715, the methods of using a linked dye having a specific linking group as disclosed in JP-A-9-189986 and JP-A-10-204306, the methods of using a linked dye having a specific structure as disclosed in JP-A-2000-231174, JP-A-2000-231172, JP-A-2000-231173, and the methods of forming a linked dye in an emulsion by using a dye having a reactive group as disclosed in JP-A-2000-81678 are exemplified.

As a preferred linked dye, a dye represented by the following formula (V) is exemplified.

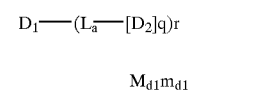

$$D_1—(L_a—[D_2]q)r \quad (V)$$

$$M_{d1}m_{d1}$$

wherein $D_1$ and $D_2$ each represents a dye chromophore; $L_a$ represents a linking group or a single bond; q and r each represents an integer of from 1 to 100; $M_{d1}$ represents a counter ion for equilibrating a charge; and $m_{d1}$ represents a number necessary to neutralize a charge in the molecule.

In the present invention, when a linked dye represented by formula (V) is adsorbed onto a silver halide grain, $D_1$ is a sensitizing dye moiety adsorbable onto a silver halide grain, and adsorption may be either physical adsorption or chemical adsorption. $D_2$ is a dye chromophore not directly adsorbed onto the silver halide grain.

That is, the adsorption strength onto a silver halide grain of $D_2$ must be weaker than that of $D_1$. The order of the adsorption strength onto a silver halide grain is preferably $D_1>L_a>D_2$, more preferably the adsorption amount of $D_2$ is 10% or less of the adsorption amount of $D_1$, particularly preferably the adsorption amount of $D_2$ is 2% or less of the adsorption amount of $D_1$, and most preferably $D_2$ is not adsorbed onto a silver halide grain at all.

The adsorption strength onto a silver halide grain of $D_1$ or $D_2$ can be presumed from the adsorption amount onto a silver halide grain of a dye compound corresponding to $D_1$ or $D_2$. As the dye compound corresponding to $D_1$ or $D_2$, a compound represented by the following formula (V) wherein linking group $L_a$ is replaced with the alkylsulfonic acid group is exemplified.

The adsorption amount onto a silver halide grain of the dye compound corresponding to $D_2$ is preferably less than 30% of the adsorption amount of the dye compound corresponding to $D_1$, more preferably less than 10%, still more preferably less than 5%, and particularly preferably the adsorption amount of the dye compound corresponding to $D_2$ is 0 or almost 0.

The adsorption amount onto a silver halide grain of a dye can be obtained by the above-described method.

The dye occupation area on a silver halide grain surface of a linked dye represented by formula (V) in the present invention is preferably 150% or less of the dye occupation area of the compound corresponding to $D_1$, more preferably 125% or less, still more preferably 110% or less, and most preferably the dye occupation area of the linked dye according to the present invention is equal to or less than the dye occupation area of the compound corresponding to $D_1$.

$L_a$ represents a linking group (preferably a divalent linking group) or a single bond. The linking group preferably comprises an atom or an atomic group containing at least one of a carbon atom, a nitrogen atom, a sulfur atom and an oxygen atom, and more preferably an organic bonding group containing one or more hetero atoms other than a carbon atom which are not a part of an amido group or an ester group. As the linking group represented by $L_a$, linking groups having from 0 to 100 carbon atoms, preferably from 1 to 20 carbon atoms, and preferably comprising in combination of one or more of an alkylene group (e.g., methylene, ethylene, trimethylene, tetramethylene, pentamethylene), an arylene group (e.g., phenylene, naphthylene), an alkenylene group (e.g., ethenylene, propenylene), an alkynylene group (e.g., ethynylene, propynylene), an amido group, an ester group, a sulfonamido group, a sulfonate group, a ureido group, a sulfonyl group, a sulfinyl group, a thioether group, an ether group, a carbonyl group, —N(Va)— (Va represents a hydrogen atom or a monovalent substituent, as the monovalent substituent, the later-described V can be exemplified), and a heterocyclic divalent group (e.g., a 6-chloro-1,3,5-triazine-2,4-diyl group, a pyrimidine-2,4-diyl group, a quinoxaline-2,3-diyl group) can be exemplified.

These linking groups may further have the later-described substituent V, or these linking groups may contain a ring (e.g., an aromatic or non-aromatic hydrocarbon ring, or a heterocyclic ring).

The linking group is more preferably a divalent linking group having from 1 to 10 carbon atoms comprising combination of one or more of an alkylene group having from 1 to 10 carbon atoms (e.g., methylene, ethylene, trimethylene, tetramethylene, pentamethylene), an arylene group having from 6 to 10 carbon atoms (e.g., phenylene, naphthylene), an alkenylene group having from 2 to 10 carbon atoms (e.g., ethenylene, propenylene), an alkynylene group having from 2 to 10 carbon atoms (e.g., ethynylene, propynylene), an ether group, an amido group, an ester group, a sulfonamido group, and a sulfonate group. These groups may be substituted with the later-described substituent V.

$L_a$ is preferably an organic linking group represented by formula (VI):

$$—G_1—(XG_2)_t—G_3— \quad (VI)$$

wherein $G_1$, $G_2$ and $G_3$ each represents 1 or 2 or more substituted or unsubstituted alkylene group (s) or alkenylene group (s) having from 1 to 20 carbon atoms (1 or 2 or more hetero atom(s) may intervene); X represents a hetero atom; and t represents 1 to 8. X preferably represents —O— or —N(R)— (where R represents H, a substituted or unsubstituted alkyl or aryl group). The linking group represented by formula (VI) may contain a saturated or unsaturated ring, and the saturated or unsaturated ring may contain a hetero atom. The unsaturated ring may be an aromatic ring. A particularly preferred linking group is a linking group in which at least one of $G_1$ and $G_3$ in formula (VI) contains an amido group, an ester group, a sulfonamido group, a carbonate group, a urethane group or a carbamoyl group.

$L_a$ is a linking group in which energy transfer or electron transfer may take place by virtue of through-bond interaction. Through-bond interaction includes tunnel interaction and super-exchange interaction, and through-bond interaction based on super-exchange interaction is preferred. Through-bond interaction and super-exchange interaction are defined in Shammai Speiser, *Chem. Rev.*, Vol. 96, pp. 1960 to 1963 (1996). As the linking groups in which energy transfer or electron transfer takes place by such interactions, the linking groups described in Shammai Speiser, *Chem. Rev.*, Vol. 96, pp. 1967 to 1969 are preferred.

q and r each represents an integer of from 1 to 100, preferably an integer of from 1 to 5, more preferably an integer of 1 or 2, and particularly preferably 1. When q and r each represents 2 or more, a plurality of $L_a$ and $D_2$ may be different linking groups and dye chromophores.

It is preferred that a dye represented by formula (V) should have electric charge of −1 at large.

More preferably, $D_1$ and $D_2$ in formula (V) each is a methine dye represented by the following formula (VII), (VIII), (IX) or (X):

(VII)

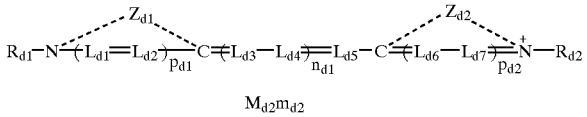

wherein $L_{d1}$, $L_{d2}$, $L_{d3}$, $L_{d4}$, $L_{d5}$, $L_{d6}$ and $L_{d7}$ each represents a methine group; $p_{d1}$ and $p_{d2}$ each represents 0 or 1; $n_{d1}$ represents 0, 1, 2, 3 or 4; $Z_{d1}$ and $Z_{d2}$ each represents an atomic group necessary to form a nitrogen-containing heterocyclic ring, and a ring may be condensed with $Z_{d1}$ and $Z_{d2}$; $M_{d2}$ represents a counter ion for equilibrating a charge; $M_{d2}$ represents a number of 0 or higher necessary to neutralize a charge in the molecule; and $R_{d1}$ and $R_{d2}$ each represents an alkyl group, an aryl group, or a heterocyclic group.

(VIII)

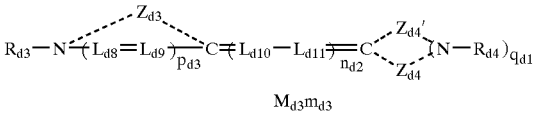

wherein $L_{d8}$, $L_{d9}$, $L_{d10}$ and $L_{d11}$ each represents a methine group; $p_{d3}$ represents 0 or 1; $q_{d1}$ represents 0 or 1; $n_{d2}$ represents 0, 1, 2, 3 or 4; $Z_{d3}$ represents an atomic group necessary to form a nitrogen-containing heterocyclic ring; $Z_{d4}$ and $Z_{d4}'$ each represents an atomic group necessary to form a heterocyclic ring or an acyclic acidic terminal group together with $(N—R_{d4})q_{d1}$, and a ring may be condensed with $Z_{d3}$, and $Z_{d4}$ and $Z_{d4}'$; $M_{d3}$ represents a counter ion for equilibrating a charge; $m_{d3}$ represents a number of 0 or higher necessary to neutralize a charge in the molecule; and $R_{d3}$ and $R_{d4}$ each represents an alkyl group, an aryl group, or a heterocyclic group.

(IX)

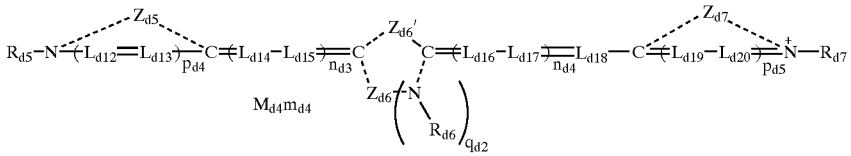

wherein $L_{d12}$, $L_{d13}$, $L_{d14}$, $L_{d15}$, $L_{d16}$, $L_{d17}$, $L_{d18}$, $L_{d19}$ and $L_{d20}$ each represents a methine group; $p_{d4}$ and $p_{d5}$ each represents 0 or 1; $q_{d2}$ represents 0 or 1; $n_{d3}$ and $n_{d4}$ each represents 0, 1, 2, 3 or 4; $Z_{d5}$ and $Z_{d7}$ each represents an atomic group necessary to form a nitrogen-containing heterocyclic ring; $Z_{d6}$ and $Z_{d6}'$ each represents an atomic group necessary to form a heterocyclic ring together with $(N—R_{d6})q_{d2}$, and a ring may be condensed with $Z_{d5}$, $Z_{d6}$ and $Z_{d6}'$, and $Z_{d7}$; $M_{d4}$ represents a counter ion for equilibrating a charge; $m_{d4}$ represents a number of 0 or higher necessary to neutralize a charge in the molecule; and $R_{d5}$, $R_{d6}$ and $R_{d7}$ each represents an alkyl group, an aryl group, or a heterocyclic group.

(X)

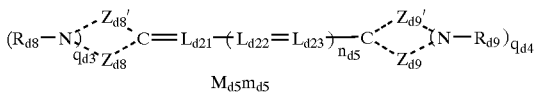

wherein $L_{d21}$, $L_{d22}$ and $L_{d23}$ each represents a methine group; $q_{d3}$ and $q_{d4}$ each represents 0 or 1; $n_{d5}$ represents 0, 1, 2, 3 or 4; $Z_{d8}$ and $Z_{d8}'$ each represents an atomic group necessary to form a heterocyclic ring or an acyclic acidic terminal group together with $(N—Rd_8)q_{d3}$, and $Z_{d9}$ and $Z_{d9}'$ each represents an atomic group necessary to form a heterocyclic ring or an acyclic acidic terminal group together with $(N—R_{d9})q_{d4}$, and a ring may be condensed with $Z_{d8}$ and $Z_{d8}'$, and $Z_{d9}$ and $Z_{d9}'$; $M_{d5}$ represents a counter ion for equilibrating a charge; $m_{d5}$ represents a number of 0 or higher necessary to neutralize a charge in the molecule; and $R_{d8}$ and $R_{d9}$ each represents an alkyl group, an aryl group, or a heterocyclic group.

$D_1$ in formula (V) adsorbs onto the surface of a silver halide grain and forms J-aggregate, and $D_1$ is preferably a methine dye represented by formula (VII), (VIII) or (IX), and more preferably a methine dye represented by formula (VII).

Methine compounds represented by formula (VII), (VIII), (IX) or (X) are described in further detail below.

In formulae (VII), (VIII) and (IX), $Z_{d1}$, $Z_{d2}$, $Z_{d3}$, $Z_{d5}$ and $Z_{d7}$ each represents an atomic group necessary to form a nitrogen-containing heterocyclic ring, preferably a 5- or 6-membered nitrogen-containing heterocyclic ring, and they may be further condensed with rings. The rings may be either aromatic or non-aromatic rings, preferably aromatic rings. Hydrocarbon aromatic rings, e.g., a benzene ring and a naphthalene ring, heterocyclic aromatic rings, e.g., a pyrazine ring and a thiophene ring are exemplified.

The examples of the nitrogen-containing heterocyclic rings include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3, 3-dimethylindolenine), an imidazoline nucleus, an imidazole nucleus, a benzimidazole nucleus, a 2-pyridine nucleus, a 4-pyridine nucleus, a 2-quinoline nucleus, 4-quinoline nucleus, a 1-isoquinoline nucleus, a 3-isoquinoline nucleus, an imidazo[4,5-b] quinoxaline nucleus, an oxadiazole nucleus, a thiadiazole nucleus, a tetrazole nucleus, and a pyrimidine nucleus. The preferred heterocyclic rings of them are a benzothiazole nucleus, a benzoxazole nucleus, a 3,3-dialkylindolenine nucleus (e.g., 3,3-dimethylindolenine), a benzimidazole nucleus, a 2-pyridine nucleus, a 4-pyridine nucleus, a 2-quinoline nucleus, 4-quinoline nucleus, a 1-isoquinoline nucleus, and a 3-isoquinoline nucleus, more preferred are a benzothiazole nucleus, a benzoxazole nucleus, a3,3-dialkylindolenine nucleus (e.g., 3,3-dimethylindolenine), and a benzimidazole nucleus, still more preferred are a benzoxazole nucleus, a benzothiazole nucleus, and a benzimidazole nucleus, and most preferred are a benzoxazole nucleus and a benzothiazole nucleus.

When a linked dye represented by formula (V) is multilayer-adsorbed onto a silver halide grain by the above preferred methods, since the $D_2$ moiety is generally present in the state of a monomer, the breadths of absorption and spectral sensitivity are broader than the desired values in almost all the cases. Therefore, for realizing high sensitivity with a desired wavelength region, it is necessary for the $D_2$ moiety to form J-aggregate. Further, since J-aggregate is great in the velocity constant of radiation deactivation, it is also preferred to transmit the light energy absorbed by the $D_2$ moiety to the $D_1$ moiety by energy transfer.

The present invention defines the J-aggregate of the $D_2$ moiety as the case where the absorption maximum of the absorption shown by the $D_2$ moiety is shifted to the longer wavelength side than the absorption maximum of the absorption shown by a dye solution in a monomer state where there are no interaction between the dye chromophores. It is known that when a J-aggregate is formed, an absorption maximum is generally shifted to the longer wavelength side as compared with a monomer state (T. H. James, *The Theory of the Photographic Process*, 4th Ed., Macmillan Publishing Co., Inc. (1977)). Accordingly, the J-aggregate of the $D_2$ moiety can be defined by the above definition.

The spectral absorption by the $D_2$ moiety can be obtained by subtracting the spectral absorption by the $D_1$ moiety from the spectral absorption of the entire emulsion.

The spectral absorption by the $D_1$ moiety can be obtained by measuring the absorption spectrum of the time when the compound corresponding to the $D_1$ moiety is added. As the dye compound corresponding to the $D_1$ moiety, a compound represented by formula (V) wherein linking group $L_a$ is replaced with the alkylsulfonic acid group is exemplified.

When the $D_2$ moiety forms J-aggregate in a dye represented by formula (V), $D_2$ is preferably a methine dye represented by formula (VII), (VIII) or (IX), more preferably a methine dye represented by formula (VII) or (VIII), and particularly preferably a methine dye represented by formula (VII). When $D_2$ is a dye represented by formula (VII), $Z_{d1}$ and $Z_{d2}$ in formula (VII) each more preferably represents a basic nucleus condensed with tricyclic or more rings, and $Z_{d1}$ and $Z_{d2}$ each most preferably represents a basic nucleus condensed with tetracyclic or more rings.

The number of condensed rings of a basic nucleus is, e.g., a benzoxazole nucleus is 2 and a naphthoxazole nucleus is 3. Further, even when a benzoxazole nucleus is substituted with a phenyl group, the number of condensed rings is 2. As basic nuclei condensed with tricyclic or more rings, any of polycyclic condensed heterocyclic basic nuclei condensed with tricyclic or more rings can be used, and tricyclic condensed heterocyclic rings and tetracyclic condensed heterocyclic rings can be exemplified as the preferred examples. The preferred examples of tricyclic condensed heterocyclic rings include naphtho[2,3-d]oxazole, naphtho[1,2-d]oxazole, naphtho[2,1-d]oxazole, naphtho[2,3-d]thiazole, naphtho[1,2-d]thiazole, naphtho[2,1-d]thiazole, naphtho[2,3-d]imidazole, naphtho[1,2-d]imidazole, naphtho-[2,1-d]imidazole, naphtho[2,3-d]selenazole, naphtho[1,2-d]-selenazole, naphtho[2,1-d]selenazole, indolo[5,6-d]oxazole, indolo[6,5-d]oxazole, indolo[2,3-d]oxazole, indolo[5,6d]-thiazole, indolo[6,5-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[6,5-d]thiazole, benzofuro[2,3-d]thiazole, benzothieno[5,6-d]oxazole, benzothieno[6,5-d]oxazole, and benzothieno[2,3-d]oxazole. The preferred examples of tetracyclic condensed heterocyclic rings include anthra [2,3-d]oxazole, anthra [1,2-d]oxazole, anthra [1,2-d]oxazole, anthra[2,3-d]thiazole, anthra[1,2-d]thiazole, phenanthro[2,1-d]thiazole, phenanthro[2,3-d]imidazole, anthra[1,2-d]imidazole, anthra[2,1-d]imidazole, anthra[2,3-d]selenazole, phenanthro[1,2-d]selenazole, phenanthro[2,1-d]selenazole, carbazolo[2,3-d]oxazole, carbazolo[3,2-d]oxazole, dibenzofuro[2,3-d]oxazole, dibenzofuro [3,2-d]oxazole, carbazolo[2,3-d]thiazole, carbazolo[3,2-d]thiazole, dibenzofuro[2,3-d]thiazole, dibenzofuro[3,2-d]thiazole, benzofuro[5,6-d]oxazole, dibenzothieno[2,3-d]oxazole, dibenzothieno[3,2-d]oxazole, tetrahydrocarbazolo[6,7-d]oxazole, tetrahydrocarbazolo-[7,6-d]oxazole, dibenzothieno[2,3-d]thiazole, dibenzothieno[3,2-d]thiazole, and tetrahydrocarbazolo[6,7-d]thiazole.

The more preferred examples of the basic nuclei condensed with tricyclic or more rings include naphtho[2,3-d]oxazole, naphtho[1,2-d]oxazole, naphtho[2,1-d]oxazole, naphtho[2,3-d]thiazole, naphtho[1,2-d]thiazole, naphtho[2,1-d]thiazole, indolo[5,6-d]oxazole, indolo[6,5-d]oxazole, indolo[2,3-d]oxazole, indolo[5,6-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[2,3-d]thiazole, benzothieno[5,6-d]oxazole, anthra[2,3-d]oxazole, anthra[1,2-d]oxazole, anthra[2,3-d]thiazole, anthra[1,2-d]thiazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole, and dibenzothieno[3,2-d]oxazole. The particularly preferred examples include naphtho[2,3-d]oxazole, naphtho[1,2-d]oxazole, naphtho[2,3-d]thiazole, indolo[5,6-d]oxazole, indolo[6,5-d]oxazole, indolo[5,6-d]thiazole, benzofuro[5,6-d]oxazole, benzofuro[5,6-d]thiazole, benzofuro[2,3-d]thiazole, benzothieno[5,6-d]oxazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole, and dibenzothieno[3,2-d]oxazole.

Taking the substituents on the nitrogen-containing heterocyclic rings, preferably the 5- or 6-membered heterocyclic rings, formed by atomic groups represented by $Z_{d1}$, $Z_{d2}$, $Z_{d3}$, $Z_{d5}$ and $Z_{d7}$ in formulae (VII), (VIII) and (IX) as V, the substituents represented by V are not particularly restricted and any substituents may be used. For example, V represents a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxyl group, an aryloxy group, a silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phosphinyl group, a phosphinyloxy group, a phosphinylamino group, or a silyl group.

More specifically, V represents a halogen atom (e.g., chlorine, bromine, iodine), an alkyl group [a straight chain, branched, cyclic, substituted or unsubstituted alkyl group, which includes an alkyl group (preferably an alkyl group having from 1 to 30 carbon atoms, e.g., methyl, ethyl, n-propyl, isopropyl, t-butyl, n-octyl, eicosyl, 2-chloroethyl, 2-cyanoethyl, 2-ethylhexyl), a cycloalkyl group (preferably a substituted or unsubstituted cycloalkyl group having from 3 to 30 carbon atoms, e.g., cyclohexyl, cyclopentyl, 4-n-dodecylcyclohexyl), a bicycloalkyl group (preferably a substituted or unsubstituted bicycloalkyl group having from 5 to 30 carbon atoms, i.e., a monovalent group obtained by eliminating one hydrogen atom from bicycloalkane having from 5 to 30 carbon atoms, e.g., bicyclo[1,2,2]heptan-2-yl, bicyclo[2,2,2]octan-3-yl), and a tricyclohexyl structure having many ring structures; the alkyl group in the substituent described below (e.g., the alkyl group in an alkylthio group) represents the alkyl group of such a concept, and the alkyl further includes an alkenyl group and an alkynyl group], an alkenyl group [a straight chain, branched, cyclic, substituted or unsubstituted alkenyl group, which includes an alkenyl group (preferably a substituted or unsubstituted alkenyl group having from 2 to 30 carbon atoms, e.g., vinyl, allyl, prenyl, geranyl, oleyl), a cycloalkenyl group (preferably a substituted or unsubstituted cycloalkenyl group having from 3 to 30 carbon atoms, i.e., a monovalent group obtained by eliminating one hydrogen atom from cycloalkene having from 3 to 30 carbon atoms, e.g., 2-cyclopenten-1-yl, 2-cyclohexen-1-yl), a bicycloalkenyl group (a substituted or unsubstituted bicycloalkenyl group, preferably a substituted or unsubstituted bicycloalkenyl group having from 5 to 30 carbon atoms, i.e., a monovalent group obtained by eliminating one hydrogen atom from bicycloalkene having one double bond, e.g., bicyclo[2,2,1]hepto-2-en-1-yl, bicyclo[2,2,2]octo-2-en-4-yl)], an alkynyl group (preferably a substituted or unsubstituted alkynyl group having from 2 to 30 carbon atoms, e.g., ethynyl, propargyl, trimethylsilylethynyl), an aryl group (preferably a substituted or unsubstituted aryl group having from 6 to 30 carbon atoms, e.g., phenyl, p-tolyl, naphthyl, m-chlorophenyl, o-hexadecanoylaminophenyl), a heterocyclic group (preferably a monovalent group obtained by eliminating one hydrogen atom from a 5- or 6-membered, substituted or unsubstituted, aromatic or non-aromatic heterocyclic compound, more preferably a 5- or 6-membered aromatic heterocyclic group having from 3 to 30 carbon atoms, e.g., 2-furyl, 2-thienyl, 2-pyrimidinyl, 2-benzothiazolyl), a cyano group, a hydroxyl group, a nitro group, a carboxyl group, an alkoxyl group (preferably a substituted or unsubstituted alkoxyl group having from 1 to 30 carbon atoms, e.g., methoxy, ethoxy, isopropoxy, t-butoxy, n-octyloxy, 2-methoxyethoxy), an aryloxy group (preferably a substituted or unsubstituted aryloxy group having from 6 to 30 carbon atoms, e.g., phenoxy, 2-methylphenoxy, 4-t-butylphenoxy, 3-nitrophenoxy, 2-tetradecanoylaminophenoxy), a silyloxy group (preferably a silyloxy group having from 3 to 20 carbon atoms, e.g., trimethylsilyloxy, t-butyldimethylsilyloxy), a heterocyclic oxy group (preferably a substituted or unsubstituted heterocyclic oxy group having from 2 to 30 carbon atoms, e.g., 1-phenyltetrazol-5-oxy, 2-tetrahydropyranyloxy), an acyloxy group (preferably a formyloxy group, a substituted or unsubstituted alkylcarbonyloxy group having from 2 to 30 carbon atoms, a substituted or unsubstituted arylcarbonyloxy group having from 6 to 30 carbon atoms, e.g., formyloxy, acetyloxy, pivaloyloxy, stearoyloxy, benzoyloxy, p-methoxy-phenylcarbonyloxy), a carbamoyloxy group (preferably a substituted or unsubstituted carbamoyloxy group having from 1 to 30 carbon atoms, e.g., N,N-dimethylcarbamoyloxy, N,N-diethylcarbamoyloxy, morpholinocarbonyloxy, N,N-di-n-octylaminocarbonyloxy, N-n-octylcarbamoyloxy), an alkoxycarbonyloxy group (preferably a substituted or unsubstituted alkoxycarbonyloxy group having from 2 to 30 carbon atoms, e.g., methoxycarbonyloxy, ethoxycarbonyloxy, t-butoxycarbonyloxy, n-octylcarbonyloxy), an aryloxycarbonyloxy group (preferably a substituted or unsubstituted aryloxycarbonyloxy group having from 7 to 30 carbon atoms, e.g., phenoxycarbonyloxy, p-methoxyphenoxycarbonyloxy, p-n-hexadecyloxyphenoxycarbonyloxy), an amino group (preferably an amino group, a substituted or unsubstituted alkylamino group having from 1 to 30 carbon atoms, a substituted or unsubstituted anilino group having from 6 to 30 carbon atoms, e.g., amino, methylamino, dimethylamino, anilino, N-methylanilino, diphenylamino), an acylamino group (preferably a formylamino group, a substituted or unsubstituted alkylcarbonylamino group having from 1 to 30 carbon atoms, a substituted or unsubstituted arylcarbonylamino group having from 6 to 30 carbon atoms, e.g., formylamino, acetylamino, pivaloylamino, lauroylamino, benzoylamino, 3,4,5-tri-n-octyloxyphenylcarbonylamino), an aminocarbonylamino group (preferably a substituted or unsubstituted aminocarbonylamino group having from 1 to 30 carbon atoms, e.g., carbamoylamino, N,N-dimethylaminocarbonylamino, N,N-diethylaminocarbonylamino, morpholinocarbonylamino), an alkoxycarbonylamino group (preferably a substituted or unsubstituted alkoxycarbonylamino group having from 2 to 30 carbon atoms, e.g., methoxycarbonylamino, ethoxycarbonylamino, t-butoxycarbonylamino, n-octadecyloxycarbonylamino, N-methylmethoxycarbonylamino), an aryloxycarbonylamino group (preferably a substituted or unsubstituted aryloxycarbonylamino group having from 7 to 30 carbon atoms, e.g., phenoxycarbonylamino, p-chlorophenoxycarbonylamino, m-(n-octyloxyphenoxycarbonylamino), a sulfamoylamino group (preferably a substituted or unsubstituted sulfamoylamino group having from 0 to 30 carbon atoms, e.g., sulfamoylamino, N,N-dimethylaminosulfonylamino, N-n-octylaminosulfonylamino), an alkylsulfonylamino group and arylsulfonylamino group (preferably a substituted or unsubstituted alkylsulfonylamino group having from 1 to 30 carbon atoms, a substituted or unsubstituted arylsulfonylamino group having from 6 to 30 carbon atoms, e.g., methylsulfonylamino, butylsulfonylamino, phenylsulfonylamino, 2,3,5-trichlorophenylsulfonylamino, p-methylphenylsulfonylamino), a mercapto group, an alkylthio group (preferably a substituted or unsubstituted alkylthio group having from 1 to 30 carbon atoms, e.g., methylthio, ethylthio, n-hexadecylthio), an arylthio group (preferably a substituted or unsubstituted arylthio group having from 6 to 30 carbon atoms, e.g., phenylthio, p-chlorophenylthio, m-methoxyphenylthio), a heterocyclic thio group (preferably a substituted or unsubstituted heterocyclic thio group having from 2 to 30 carbon atoms, e.g., 2-benzothiazolylthio, 1-phenyltetrazol-5-ylthio), a sulfamoyl group (preferably a substituted or unsubstituted sulfamoyl group having from 0 to 30 carbon atoms, e.g., N-ethylsulfamoyl, N-(3-dodecyloxypropyl)sulfamoyl, N,N-dimethylsulfamoyl, N-acetylsulfamoyl, N-benzoylsulfamoyl, N-(N'-phenylcarbamoyl)sulfamoyl), a sulfo group, an alkylsulfinyl group and arylsulfinyl group (preferably a substituted or unsubstituted alkylsulfinyl group having from 1 to 30 carbon atoms, a substituted or unsubstituted arylsulfinyl group having from 6 to 30 carbon atoms, e.g., methylsulfinyl, ethylsulfinyl, phenylsulfinyl, p-methylphenylsulfinyl), an alkylsulfonyl group and arylsulfonyl group (preferably a substituted or unsubstituted alkylsulfonyl group having from 1 to 30 carbon atoms, a substituted or unsubstituted arylsulfonyl group having from 6 to 30 carbon atoms, e.g., methylsulfonyl, ethylsulfonyl, phenylsulfonyl, p-methylphenylsulfonyl), an acyl group (preferably a formyl group, a substituted or unsubstituted alkylcarbonyl group having from 2 to 30 carbon atoms, a substituted or unsubstituted arylcarbonyl group having from 7 to 30 carbon atoms, a substituted or unsubstituted heterocyclic carbonyl group having from 4 to 30 carbon atoms bonded to the carbonyl group via a carbon atom, e.g., acetyl, pivaloyl, 2-chloroacetyl, stearoyl, benzoyl, p-n-octyloxyphenylcarbonyl, 2-pyridylcarbonyl, 2-furylcarbonyl), an aryloxycarbonyl group (preferably a substituted or unsubstituted aryloxycarbonyl group having from 7 to 30 carbon atoms, e.g., phenoxycarbonyl, o-chlorophenoxycarbonyl, m-nitrophenoxycarbonyl, p-t-butylphenoxycarbonyl), an alkoxycarbonyl group (preferably a substituted or unsubstituted alkoxycarbonyl group having from 2 to 30 carbon atoms, e.g., methoxycarbonyl, ethoxycarbonyl, t-butoxycarbonyl, n-octadecyloxycarbonyl), a carbamoyl group (preferably a substituted or unsubstituted carbamoyl group having from 1 to 30 carbon atoms, e.g., carbamoyl, N-methylcarbamoyl, N,N-dimethylcarbamoyl, N,N-di-n-octylcarbamoyl, N-(methylsulfonyl)carbamoyl), an arylazo group and heterocyclic azo group (preferably a substituted or unsubstituted arylazo group having from 6 to 30 carbon atoms, a substituted or unsubstituted heterocyclic azo group having from 3 to 30 carbon atoms, e.g., phenylazo, p-chlorophenylazo, 5-ethylthio-1,3,4-thiadiazol-2-ylazo), an imido group (preferably N-succinimido, N-phthalimido), a phosphino group (preferably a substituted or unsubstituted phosphino group having from 2 to 30 carbon atoms, e.g., dimethylphosphino, diphenylphosphino, methylphenoxyphosphino), a phosphinyl group (preferably a substituted or unsubstituted phosphinyl group having from 2 to 30 carbon atoms, e.g., phosphinyl, dioctyloxyphosphinyl, diethoxyphosphinyl), a phosphinyloxy group (preferably a substituted or unsubstituted phosphinyloxy group having from 2 to 30 carbon atoms, e.g., diphenoxyphosphinyloxy, dioctyloxyphosphinyloxy), a phosphinylamino group (preferably a substituted or unsubstituted phosphinylamino group having from 2 to 30 carbon atoms, e.g., dimethoxyphosphinylamino, dimethylaminophosphinylamino), or a silyl group (preferably a substituted or unsubstituted silyl group having from 3 to 30 carbon atoms, e.g., trimethylsilyl, t-butyldimethylsilyl, phenyldimethylsilyl).

Rings may be condensed. For example, an aromatic or non-aromatic hydrocarbon ring or heterocyclic ring may form a polycyclic condensed ring in combination. The examples of such rings include a benzene ring, a naphthalene ring, an anthracene ring, a quinoline ring, a phenanthrene ring, a fluorene ring, a triphenylene ring, a naphthacene ring, a biphenyl ring, a pyrrole ring, a furan ring, a thiophene ring, an imidazole ring, an oxazole ring, a thiazole ring, a pyridine ring, a pyrazine ring, a pyrimidine ring, a pyridazine ring, an indolizine ring, an indole ring, a benzofuran ring, a benzothiophene ring, an isobenzofuran ring, a quinolizine ring, a quinoline ring, a phthalazine ring, a naphthyridine ring, a quinoxaline ring, a quinoxazoline ring, a carbazole ring, a phenanthridine ring, an acridine ring, a phenanthroline ring, a thianthrene ring, a chromene ring, a xanthene ring, a phenoxathine ring, a phenothiazine ring, and a phenazine ring.

Of the above functional groups, those having hydrogen atoms may be substituted with the above substituents after removing the hydrogen atoms. The examples of such functional groups include an alkylcarbonylaminosulfonyl group, an arylcarbonylaminosulfonyl group, an alkylsulfonylaminocarbonyl group, and an arylsulfonylaminocarbonyl group, and the examples of the substituted groups include a methylsulfonylaminocarbonyl group, a p-methylphenylsulfonylaminocarbonyl group, an acetylaminosulfonyl group, and a benzoylaminosulfonyl group.

The preferred substituents V are the alkyl group, aryl group, alkoxyl group, halogen atom, aromatic condensed ring, sulfo group, carboxyl group and hydroxyl group.

When a linked dye represented by formula (V) is multilayer-adsorbed onto the surface of a silver halide grain, $D_2$ is not directly adsorbed onto the silver halide grain. For that sake, when a methine dye represented by formula (VII), (VIII), (IX) or (X) represents a dye chromophore represented by $D_2$ in formula (V), the substituents V on $Z_{d1}$, $Z_{d2}$, $Z_{d3}$, $Z_{d5}$ and $Z_{d7}$ are more preferably a carboxyl group, a sulfo group and a hydroxyl group, still more preferably a sulfo group and a carboxyl group, and particularly preferably a sulfo group.

A linked dye represented by formula (V) can be multilayer-adsorbed onto the surface of a silver halide grain, to thereby form a multilayer structure according to the above-described preferred methods.

$Z_{d4}$ and $Z_{d4}'$ and $(N—R_{d4})_{qd1}$, $Z_{d8}$ and $Z_{d8}'$ and $(N—R_{d8})_{qd3}$, and $Z_{d9}$ and $Z_{d9}'$ and $(N—R_{d9})_{qd4}$ each represents an atomic group necessary to form a heterocyclic ring or an acyclic acidic terminal group together. The heterocyclic ring (preferably a 5- or 6-membered ring) may be any ring but acidic nuclei are preferred. The acidic nucleus and acyclic acidic terminal group are described below. The acidic nucleus and acyclic acidic terminal group may take any form of acidic nucleus and acyclic acidic terminal group of general merocyanine dyes. Preferably, $Z_{d4}$, $Z_{d8}$ and $Z_{d9}$ each represent a thiocarbonyl group, a carbonyl group, an ester group, an acyl group, a carbamoyl group, a cyano group, or a sulfonyl group, and more preferably a thiocarbonyl group or a carbonyl group. $Z_{d4}'$, $Z_{d8}'$ and $Z_{d9}'$ each represents the residual atomic group necessary to form an acidic nucleus and an acyclic acidic terminal group. For forming an acyclic acidic terminal group, a thiocarbonyl group, a carbonyl group, an ester group, an acyl group, a carbamoyl group, a cyano group, and a sulfonyl group are preferred.

$_{qd1}$, $_{qd3}$ and $_{qd4}$ each preferably represents 0 or 1, preferably 1.

The acidic nuclei and acyclic acidic terminal groups are described, for example, in James, *The Theory of the Photographic Process*, 4th Ed.,pp. 198 to 200, Macmillan (1977). "The acyclic acidic terminal groups" in the present invention means those which do not form a ring of acidic terminals, i.e., electron-accepting terminals.

Acidic nuclei and acyclic acidic terminal groups are specifically disclosed in U.S. Pat. Nos. 3,567,719, 3,575,869, 3,804,634, 3,837,862, 4,002,480, 4,925,777, JP-A-3-167546, U.S. Pat. Nos. 5,994,051 and 5,747,236.

Acidic nuclei are preferably used for forming heterocyclic rings (preferably 5- or 6-membered nitrogen-containing heterocyclic rings) comprising carbon, nitrogen, and/or chalcogen atoms (typically, oxygen, sulfur, selenium and tellurium), more preferably for forming 5- or 6-membered nitrogen-containing heterocyclic rings comprising carbon, nitrogen, and/or chalcogen atoms (typically, oxygen, sulfur, selenium and tellurium). Specifically, the following nuclei can be exemplified.

The nuclei of 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazolidine-2,5-dione, 2-thiooxazoline-2,4-dione, isooxazolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituricacid, 2-thiobarbituricacid, chroman-2,4-dione, indazolin-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide, and 3-dicyanomethine-2,3-dihydrobenzo[d]thiophene-1,1-dioxide can be exemplified.

Further examples include nuclei having exo-methylene structure obtained by substituting a carbonyl group or a thiocarbonyl group constituting these nuclei on the active methylene position of acidic nuclei, and nuclei having exo-methylene structure obtained by substituting a carbonyl group or a thiocarbonyl group on the active methylene position of active methylene compounds having the structure of keto-methylene and cyanomethylene which are raw materials of acyclic acidic terminal groups.

These acidic nuclei and acyclic acidic terminal groups may be substituted or condensed with the above substituents V or rings.

$Z_{d4}$ and $Z_{d4}'$ and $(N—R_{d4})_{qd1}$, $Z_{d8}$ and $Z_{d8}'$ and $(N—R_{d8})_{qd3}$, and $Z_{d9}$ and $Z_{d9}'$ and $(N—R_{d9})_{qd4}$ preferably represents hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid and 2-thiobarbituric acid, more preferably hydantoin, 2- or 4-thiohydantoin, 2-oxazolin-5-one, rhodanine, barbituric acid and 2-thiobarbituric acid, and particularly preferably 2- or 4-thiohydantoin, 2-oxazolin-5-one, rhodanine and barbituric acid.

As the heterocyclic rings formed by $Z_{d6}$, $Z_{d6}'$ and $(N—R_{d6})_{qd2}$, the same heterocyclic rings as those described in the heterocyclic rings formed by $Z_{d4}$ and $Z_{d4}'$ and $(N—R_{d4})_{qd1}$, $Z_{d8}$ and $Z_{d8}'$ and $(N—R_{d8})_{qd3}$, and $Z_{d9}$ and $Z_{d9}'$ and $(N—R_{d9})_{qd4}$ can be exemplified. The preferred heterocyclic rings are those obtained by eliminating an oxo group or a thioxo group from the acidic nuclei described in the explanation of the heterocyclic ring of $Z_{d4}$ and $Z_{d4}'$ and $(N—R_{d4})_{qd1}$, $Z_{d8}$ and $Z_{d8}'$ and $(N—R_{d8})_{qd3}$, and $Z_{d9}$ and $Z_{d9}'$ and $(N—R_{d9})_{qd4}$.

The still more preferred examples of heterocyclic rings are those obtained by eliminating an oxo group or a thioxo group from hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, or 2-thiobarbituric acid, the particularly preferred examples of heterocyclic rings are those obtained by eliminating an oxo group or a thioxo group from hydantoin, 2- or 4-thiohydantoin, 2-oxazolin-5-one, rhodanine, barbituric acid, or 2-thiobarbituric acid, and the most preferred examples are those obtained by eliminating an oxo group or a thioxo group from 2- or 4-thiohydantoin, 2-oxazolin-5-one, or rhodanine.

$_{qd2}$ represents 0 or 1, preferably 1.

$R_{d1}$, $R_{d2}$, $R_{d3}$, $R_{d4}$, $R_{d5}$, $R_{d6}$, $R_{d7}$, $R_8$ and $R_{d9}$ each preferably represents an alkyl group, an aryl group or a heterocyclic group, and the specific examples thereof include, e.g., an unsubstituted alkyl group having from 1 to 18, preferably from 1 to 7, and particularly preferably from 1 to 4, carbon atoms (e.g., methyl, ethyl, propyl, isopropyl, butyl, isobutyl, hexyl, octyl, dodecyl, octadecyl), a substituted alkyl group having from 1 to 18, preferably from 1 to 7, and particularly preferably from 1 to 4, carbon atoms [e.g., an alkyl group substituted with the above-described substituent V can be exemplified, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2- (1-naphthoxy) ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), a heterocyclic group-substituted alkyl group (e.g., 2-(pyrrolidin-2-one-1-yl)ethyl, tetrahydrofurfuryl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl), an alkylsulfonylsulfamoylalkyl group (e.g., methanesulfonylsulfamoylmethyl)], a substituted or unsubstituted aryl group having from 6 to 20, preferably from 6 to 10, and more preferably from 6 to 8, carbon atoms (the above V can be exemplified as substituents, e.g., phenyl, 1-naphthyl, p-methoxyphenyl, p-methylphenyl, p-chlorophenyl), an unsubstituted heterocyclic group having from 1 to 20, preferably from 3 to 10, and more preferably from 4 to 8, carbon atoms (the above V can be exemplified as substituents, e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl, 5-methyl-2-thienyl, 4-methoxy-2-pyridyl).

When a methine dye represented by formula (VII), (VIII), (IX) or (X) represents a dye chromophore represented by $D_1$ in formula (V), the substituents represented by $R_{d1}$, $R_{d2}$, $R_{d3}$, $R_{d4}$, $R_{d5}$, $R_{d6}$, $R_{d7}$, $R_{d8}$ and $R_{d9}$ are preferably unsubstituted alkyl groups or substituted alkyl groups (e.g., a carboxyalkyl group, a sulfoalkyl group, an aralkyl group and an aryloxyalkyl group).

When a methine dye represented by formula (VII), (VIII), (IX) or (X) represents a dye chromophore represented by $D_2$ in formula (V), the substituents represented by $R_{d1}$, $R_{d2}$, $R_{d3}$, $R_{d4}$, $R_{d5}$, $R_{d6}$, $R_{d7}$, $R_{d8}$ and $R_{d9}$ are preferably unsubstituted alkyl groups or substituted alkyl groups, more preferably alkyl groups having an anionic substituent (e.g., a carboxyalkyl group, a sulfoalkyl group), and still more preferably a sulfoalkyl group.

$L_{d1}$, $L_{d2}$, $L_{d3}$, $L_{d4}$, $L_{d5}$, $L_{d6}$, $L_{d7}$, $L_{d8}$, $L_{d9}$, $L_{d10}$, $L_{d11}$, $L_{d12}$, $L_{d13}$, $L_{d14}$, $L_{d15}$, $L_{d16}$, $L_{d17}$, $L_{d18}$, $L_{d19}$, $L_{d20}$, $L_{d21}$, $L_{d22}$ and $L_{d23}$ each represents a methine group. Each of these methine groups represented by $L_{d1}$ to $L_{d23}$ may have a substituent and the above-described V can be exemplified as the substituents. For example, a substituted or unsubstituted alkyl group having from 1 to 15, preferably from 1 to 10, and particularly preferably from 1 to 5, carbon atoms (e.g., methyl, ethyl, 2-carboxyethyl), a substituted or unsubstituted aryl group having from 6 to 20, preferably from 6 to 15, and more preferably from 6 to 10, carbon atoms (e.g., phenyl, o-carboxyphenyl), a substituted or unsubstituted heterocyclic group having from 3 to 20, preferably from 4 to 15, and more preferably from 6 to 10, carbon atoms (e.g., N,N-diethylbarbituric acid), a halogen atom (e.g., chlorine, bromine, iodine, fluorine), an alkoxyl group having from 1 to 15, preferably from 1 to 10, and more preferably from 1 to 5, carbon atoms (e.g., methoxy, ethoxy), an amino group having from 0 to 15, preferably from 2 to 10, and more preferably from 4 to 10, carbon atoms (e. g., methylamino, N, N-dimethylamino, N-methyl-N-phenylamino, N-methylpiperazino), an alkylthio group having from 1 to 15, preferably from 1 to 10, and more preferably from 1 to 5, carbon atoms (e.g., methylthio, ethylthio), an arylthio group having from 6 to 20, preferably from 6 to 12, and more preferably from 6 to 10, carbon atoms (e.g., phenylthio, p-methylphenylthio) can be exemplified as the substituents. Each of these methine groups may form a ring together with other methine groups or can form a ring together with $Z_{d1}$ to $Z_{d9}$, and $R_{d1}$ to $R_{d9}$.

$L_{d1}$, $L_{d2}$, $L_{d6}$, $L_{d7}$, $L_{d8}$, $L_{d9}$, $L_{d12}$, $L_{d13}$, $L_{d19}$ and $L_{d20}$ each preferably represents an unsubstituted methine group.

$n_{d1}$, $n_{d2}$, $n_{d3}$, $n_{d4}$ and $n_{d5}$ each represents 0, 1, 2, 3 or 4, preferably 0, 1, 2 or 3, more preferably 0, 1 or 2, and particularly preferably 0. When $n_{d1}$, $n_{d2}$, $n_{d3}$, $n_{d4}$ and $n_{d5}$ each represents 2 or more, a methine group is repeated but they need not be the same.

$p_{d1}$, $p_{d2}$, $p_{d3}$, $p_{d4}$ and $p_{d5}$ each represents 0 or 1, and preferably 0.

$M_{d1}$, $M_{d2}$, $M_{d3}$, $M_{d4}$ and $M_{d5}$ are included in the formula to show the presence of a cation or an anion when a counter ion is necessary to neutralize the ionic charge of the dye. The examples of representative cations include inorganic ions such as a hydrogen ion ($H^+$), an alkali metal ion (e.g., a sodium ion, a potassium ion, a lithium ion), and an alkaline earth metal ion (e.g., a calcium ion), and organic ions such as an ammonium ion (e.g., an ammonium ion, a tetraalkylammonium ion, a triethylammonium ion, pyridinium, ethylpyridinium, and a 1,8-diazabicyclo[5.4.0]-7-undecenium ion. Anions may be either inorganic anions or organic anions, and the examples include inorganic ions such as a halogen anion (e.g., a fluorine ion, a chlorine ion, an iodine ion), a substituted arylsulfonic acid ion (e.g., a p-toluenesulfonic acid ion, a p-chlorobenzene-sulfonic acid ion), an aryldisulfonic acid ion (e.g., a 1,3-benzenedisulfonic acid ion, a 1,5-naphthalenedisulfonic acid ion, a 2,6-naphthalenedisulfonic acid ion), an alkylsulfuric acid ion (e.g., a methylsulfuric acid ion), a sulfuric acid ion, a thiocyanic acid ion, a perchloric acid ion, a tetrafluoroboric acid ion, a picric acid ion, an acetic acid ion, and a trifluoromethanesulfonic acid ion. In addition, ionic polymers or other dyes having a counter charge to the dye may be used. Further, $CO_2^-$ and $SO_3^-$ can be described as $CO_2H$ and $SO_3H$ when they have hydrogen ions as the counter ions.

$m_{d1}$, $m_{d2}$, $m_{d3}$, $m_{d4}$ and $m_{d5}$ each represents a number of 0 or higher necessary to neutralize a charge in the molecule, preferably a number of from 0 to 4, more preferably 0 or 1, and represents 0 when an inner salt is formed.

As the dyes for use as $D_2$ in formula (V), such compounds that a geometrical isomer relating to a methine chain does not isomerize in an excitation state can also be preferably used. Crosslinking structure is utilized as a method for preventing isomerization in an excitation state. Above all, compounds which are fixed so as to become all-trans structure by crosslinking methine chains are preferred. The compounds having such crosslinking structure are disclosed, e.g., in British Patents 610,064, 618,889, U.S. Pat. Nos. 4,490,463, 2,541,400 and 3,148,187.

As methine compounds which are fixed so as to become all-trans structure by crosslinking methine chains, compounds represented by the following formula (XI) or (XII) can be used.

(XI)

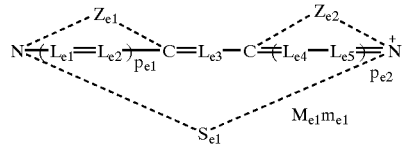

(XII)

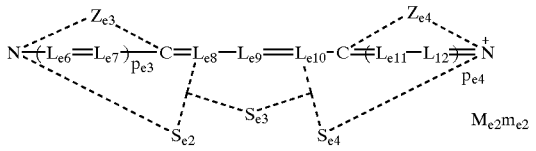

In formula (XI), $L_{e1}$, $L_{e2}$, $L_{e3}$, $L_{e4}$ and $L_{e5}$ each represents a methine group; $S_{e1}$ represents a linking group; $Z_{e1}$ and $Z_{e2}$ each represents an atomic group necessary to form a 5- or 6-membered nitrogen-containing heterocyclic ring, and they may be further condensed; $p_{e1}$ and $p_{e2}$ each represents 0 or 1; $M_{e1}$ represents a counter ion for equilibrating a charge; and $m_{e1}$ represents a number of from 0 to 10 necessary to neutralize a charge in the molecule.

In formula (XII), $L_{e6}$, $L_{e7}$, $L_{e8}$, $L_{e9}$, $L_{e10}$, $L_{e11}$ and $L_{e12}$ each represents a methine group; $S_{e2}$, $S_{e3}$ and $S_{e4}$ each represents a linking group; $Z_{e3}$ and $Z_{e4}$ each represents an atomic group necessary to form a 5- or 6-membered nitrogen-containing heterocyclic ring, and they may be further condensed; $p_{e3}$ and $p_{e4}$ each represents 0 or 1; $M_{e2}$ represents a counter ion for equilibrating a charge; and $M_{e2}$ represents a number of from 0 to 10 necessary to neutralize a charge in the molecule.

In formulae (XI) and (XII), $Z_{e1}$, $Z_{e2}$, $Z_{e3}$ and $Z_{e4}$ each represents an atomic group necessary to form a nitrogen-containing heterocyclic ring, preferably a 5- or 6-membered nitrogen-containing heterocyclic ring, and they may be further condensed with rings. The rings may be either aromatic or non-aromatic rings, preferably aromatic rings. Hydrocarbon aromatic rings, e.g., a benzene ring and a naphthalene ring, heterocyclic aromatic rings, e.g., a pyrazine ring and a thiophene ring are exemplified.

As the nitrogen-containing heterocyclic rings, the nitrogen-containing heterocyclic rings formed by atomic groups represented by $Z_{d1}$, $Z_{d2}$, $Z_{d3}$, $Z_{d5}$ and $Z_{d7}$ in formulae (VII), (VIII) and (IX), preferably those described as the examples of 5- or 6-membered nitrogen-containing heterocyclic rings, can be used.

As the substituents on the nitrogen-containing heterocyclic rings, preferably 5- or 6-membered nitrogen-containing heterocyclic rings, formed by atomic groups represented by $Z_{e1}$, $Z_{e2}$, $Z_{e3}$ and $Z_{e4}$ in formulae (XI) and (XII), the substituents exemplified as substituents V on the nitrogen-containing heterocyclic rings, preferably 5- or 6-membered nitrogen-containing heterocyclic rings, formed by atomic groups represented by $Z_{d1}$, $Z_{d2}$, $Z_{d3}$, $Z_{d5}$ and $Z_{d7}$ in formulae (VII), (VIII) and (IX) can be used.

When a linked dye represented by formula (V) is multilayer-adsorbed onto the surface of a silver halide grain, $D_2$ is not directly adsorbed onto the silver halide grain. For that sake, when a methine dye represented by formula (XI) or (XII) represents a dye chromophore represented by $D_2$ in formula (V), the substituents V on $Z_{e1}$, $Z_{e2}$, $Z_{e3}$ and $Z_{e4}$ are more preferably a carboxyl group, a sulfo group and a hydroxyl group, still more preferably a sulfo group and a carboxyl group, and particularly preferably a sulfo group.

$S_{e1}$, $S_{e2}$, $S_{e3}$ and $S_{e4}$ each represents a linking group. The linking group preferably comprises an atom or an atomic group containing at least one of a carbon atom, a nitrogen atom, a sulfur atom and an oxygen atom. The linking group is a linking group having from 0 to 100 carbon atoms, preferably from 1 to 20 carbon atoms, and preferably comprising combination of one or more of an alkylene group (e.g., methylene, ethylene, propylene, butylene, pentylene), an arylene group (e.g., phenylene, naphthylene), an alkenylene group (e.g., ethenylene, propenylene), an alkynylene group (e.g., ethynylene, propynylene), an amido group, an ester group, a sulfonamido group, a sulfonate group, a ureido group, a sulfonyl group, a sulfinyl group, a thioether group, an ether group, a carbonyl group, —N(Va)— (Va represents a hydrogen atom or a monovalent substituent, as the monovalent substituent, the above-described V can be exemplified), and a heterocyclic divalent group (e.g., a 6-chloro-1,3,5-triazine-2,4-diyl group, a pyrimidine-2,4-diyl group, a quinoxaline-2,3-diyl group).

The linking group is more preferably a divalent linking group having from 1 to 20 carbon atoms comprising combination of one or more of an alkylene group having from 1 to 10 carbon atoms (e.g., methylene, ethylene, propylene, butylene), an arylene group having from 6 to 10 carbon atoms (e.g., phenylene, naphthylene), an alkenylene group having from 2 to 10 carbon atoms (e.g., ethenylene, propenylene), an alkynylene group having from 2 to 10 carbon atoms (e.g., ethynylene, propynylene), an ether group, an amido group, an ester group, a sulfonamido group, and a sulfonate group. These groups may be substituted with the above-described substituent V.

These linking groups may further have the above-described substituent V, or these linking groups may contain a ring (e.g., an aromatic or non-aromatic hydrocarbon ring, or a heterocyclic ring).

The above method of using a dye represented by formula (V) is preferable to the method of using formula (I), (II) (III) or (IV).

The specific examples of the dyes which are used in particularly preferred methods described above in detail are shown below, but the present invention is not limited thereto.

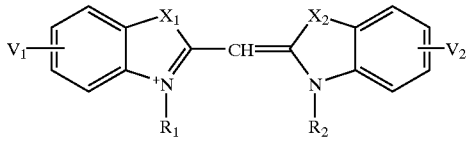

| | $X_1$ | $X_2$ | $V_1$ | $V_2$ | $R_1$ | $R_2$ | Y |
|---|---|---|---|---|---|---|---|
| D-1 | S | S | 5-Ph | 5-Ph | OPh | OPh | $SO_3^-$ |
| D-2 | S | S | 5,6-benzo | 5,6-benzo | OPh | OPh | $SO_3^-$ |
| D-3 | S | S | 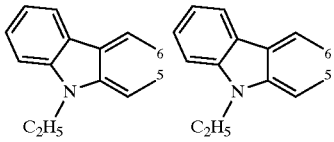 | | OPh | OPh | $SO_3^-$ |

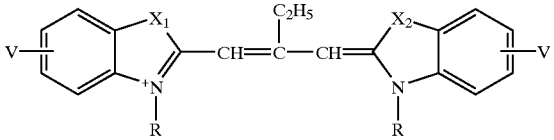

| | $X_1$ | $X_2$ | V | R | Y |
|---|---|---|---|---|---|
| D-4 | O | S | 5-Ph | OPh | $SO_3^-$ |

-continued
| | | | | | |
|---|---|---|---|---|---|
| D-5 | O | O | 5-Ph | OPh | $SO_3^-$ |
| D-6 | S | S | 5-Ph | OPh | $SO_3^-$ |
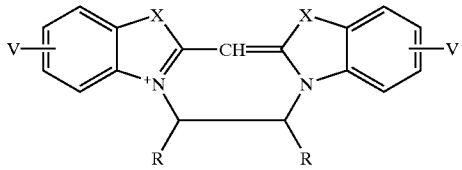
| | X | V | R | Y |
|---|---|---|---|---|
| D-7 | S | 5-Ph | OPh | $SO_3^-$ |
| D-8 | S | 5,6-benzo | OPh | $SO_3^-$ |
| D-9 | S | 5-Ph | $-O_3S$ | $HN^+(C_2H_5)$ |
| D-10 | S | 5,6-benzo | $-O_3S$ | $HN^+(C_2H_5)$ |
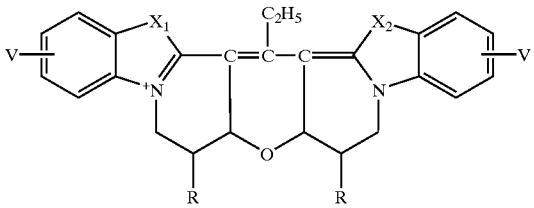
| | $X_1$ | $X_2$ | V | R | Y |
|---|---|---|---|---|---|
| D-11 | O | O | 5-Ph | OPh | $SO_3^-$ |
| D-12 | O | S | 5-Ph | OPh | $SO_3^-$ |
| D-13 | O | O | 5,6-benzo | OPh | $SO_3^-$ |

-continued
| | | | | | |
|---|---|---|---|---|---|
| D-14 | S | S | 5-Ph | OPh | $SO_3^-$ |
| D-15 | O | O | 5-Ph | $-O_3S$ | $HN^+(C_2H_5)$ |
| D-16 | O | S | 5-Ph | $-O_3S$ | $HN^+(C_2H_5)$ |
| D-17 | O | O | 5,6-benzo | $-O_3S$ | $HN^+(C_2H_5)$ |
| D-18 | S | S | 5-Ph | $-O_3S$ | $HN^+(C_2H_5)$ |
D-19
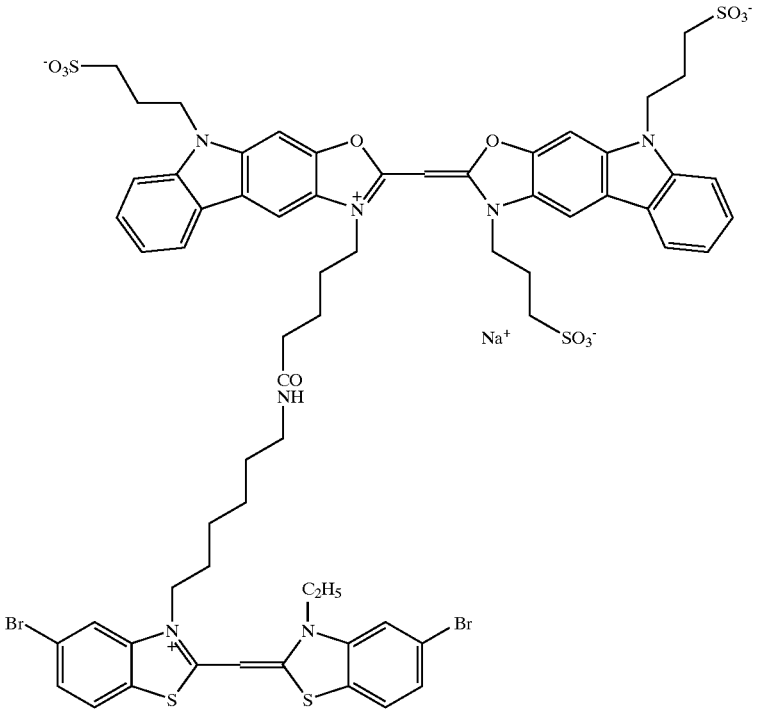

-continued
D-20
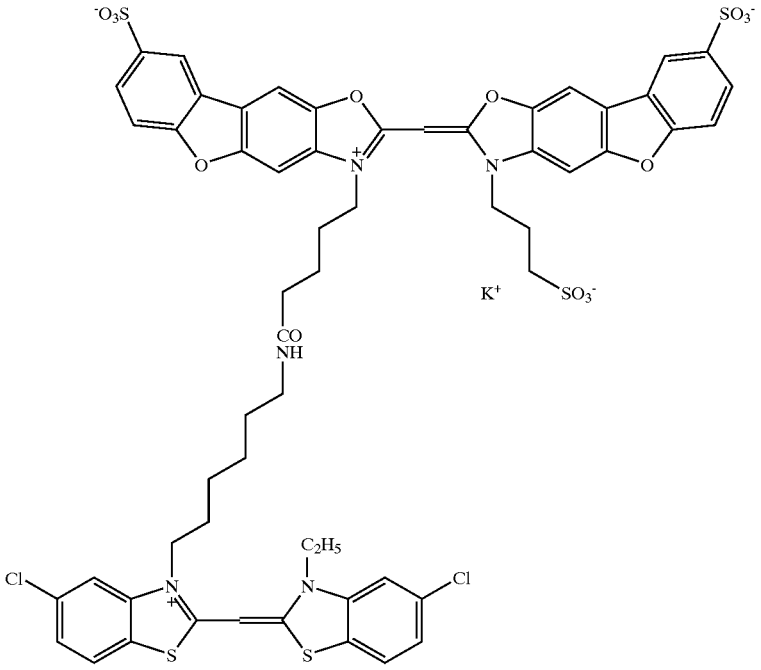
D-21
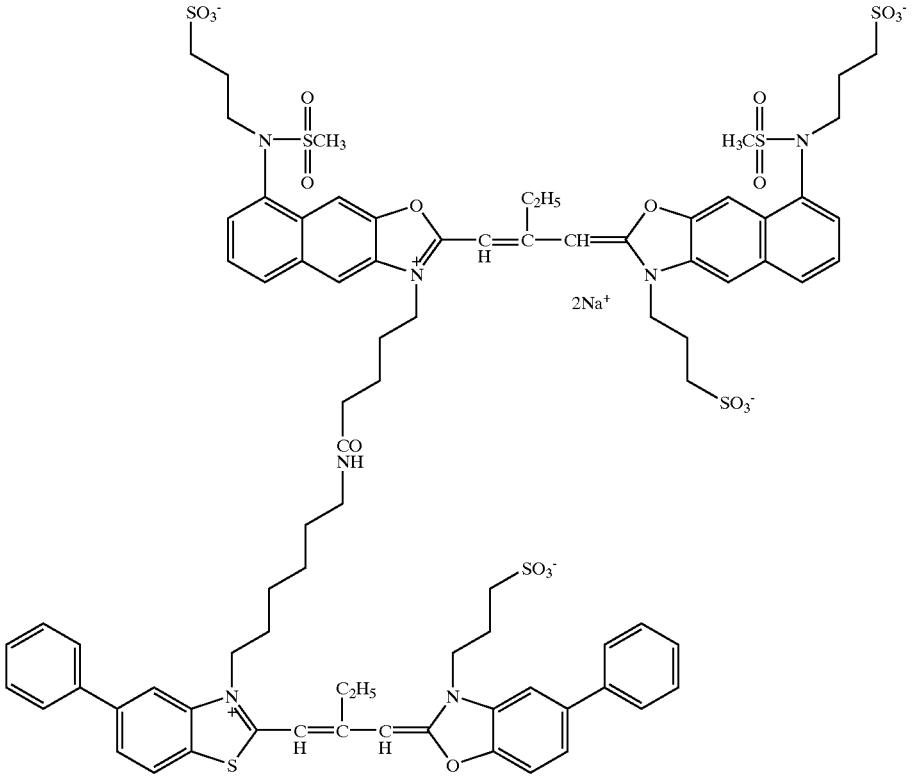

-continued

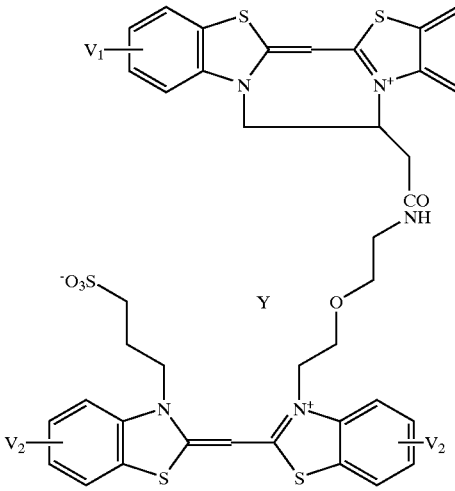

| | $V_1$ | $V_2$ | Y |
|---|---|---|---|
| D-22 | 5-$SO_3^-$ | 5-Ph | $HN^+(C_2H_5)_3$ |
| D-23 | 5,6-benzo | 5-Cl | 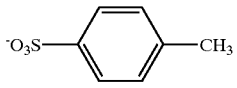 |

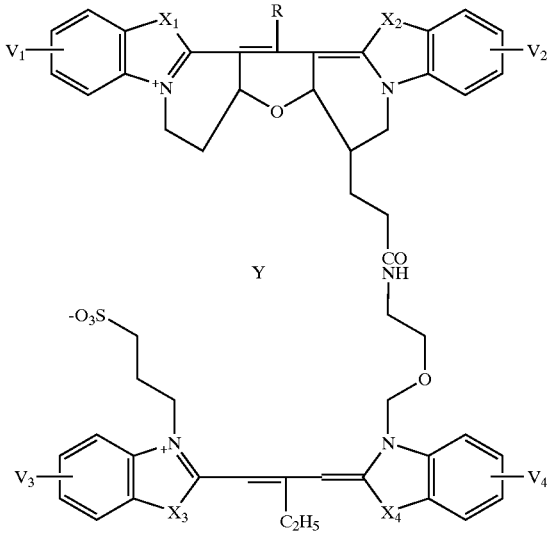

| | $X_1$ | $X_2$ | $X_3$ | $X_4$ | $V_1$ | $V_2$ | $V_3$ | $V_4$ | R | Y |
|---|---|---|---|---|---|---|---|---|---|---|
| D-24 | S | O | O | O | 4,5-benzo | 5-$SO_3^-$ | 5-Ph | 5-Ph | —$C_2H_5$ | |
| D-25 | S | O | O | O | 4,5-benzo | 5-$SO_3^-$ | 5-Ph | 5-Cl | —$C_2H_5$ | |
| D-26 | S | O | O | O | 4,5-benzo | 5-$SO_3^-$ | 4,5-benzo | 5-Cl | —$C_2H_5$ | |
| D-27 | S | O | O | O | 4,5-benzo | 5-$SO_3^-$ | 4,5-benzo | 5,6-benzo | —$C_2H_5$ | |
| D-28 | S | O | O | O | 4,5-benzo | 5-$SO_3^-$ | 5-Cl | 5-H | —$C_2H_5$ | |
| D-29 | O | O | O | S | 5,6-benzo | 5,6-benzo | 5-Ph | 5-Ph | —H | 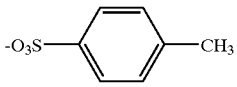 |
| D-30 | S | S | S | S | 5,6-benzo | 5,6-benzo | 5-Cl | 5-Cl | —H | 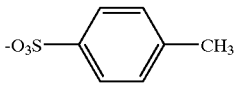 |

The sensitizing dye according to the present invention can be synthesized according to the methods described in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515, John Wiley & Sons, New York, London (1977), *Rodd's Chemistry of Carbon Compounds*, 2nd Ed., Vol. IV, Part B, Chap. 15, pp. 369 to 422, Elsevier Science Publishing Company Inc., New York (1977), and the above-described patent specifications (those quoted for specific explanations).

Not only the sensitizing dyes according to the present invention but sensitizing dyes other than the dyes of the present invention may be used, alone or in combination. A cyanine dye, a merocyanine dye, a rhodacyanine dye, a trinuclear merocyanine dye, a tetranuclear merocyanine dye, an allopolar dye, a hemicyanine dye and a styryl dye are preferably used. More preferred dyes are a cyanine dyes, a merocyanine dye and a rhodacyanine dye, and a cyanine dye is particularly preferably used. These dyes are described in detail in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515.

The formulae and the sensitizing dyes shown by the specific examples disclosed on pages 32 to 44 in U.S. Pat. No. 5,994,051 and on pages 30 to 39 in U.S. Pat. No. 5,747,236 can be exemplified as the preferred dyes.

Further, formulae (XI), (XII) and (XIII), columns 21 and 22 in U.S. Pat. No. 5,340,694 can be exemplified as the preferred formulae of cyanine, merocyanine and rhodacyanine dyes, respectively (however, the numbers of $n_{12}$, $n_{15}$, $n_{17}$ and $n_{18}$ are not restricted here and regarded as the integers of 0 or more (preferably 4 or less)).

These sensitizing dyes may be used alone or in combination of two or more kinds. A combination of sensitizing dyes is often used for the purpose of supersensitization. The representative examples of combinations are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,303,377, 3,769,301, 3,814,609, 3,837,862, 4,026,707, British Patents 1,344,281, 1,507,803, JP-B-43-49336 (the term "JP-B" as used herein means an "examined Japanese patent publication"), JP-B-53-12375, JP-A-52-110618 and JP-A-52-109925.

Dyes which themselves do not have a spectral sensitizing function or substances which substantially do not absorb visible light but show supersensitization can be incorporated into an emulsion with sensitizing dyes.

Useful supersensitizers for use in spectral sensitization in the present invention (e.g., pyrimidylamino compounds, triazinylamino compounds, azolium compounds, aminostyryl compounds, aromatic organic acid-formaldehyde condensed products, azaindene compounds, cadmium salts) and the combinations of supersensitizers with sensitizing dyes are disclosed, e.g., in U.S. Pat. Nos. 3,511,664, 3,615,613, 3,615,632, 3,615,641, 4,596,767, 4,945,038, 4,965,182, 2,933,390, 3,635,721, 3,743,510, 3,617,295, and 3,635,721, and the using methods disclosed in these patents are also preferably used.

The time of the addition of the sensitizing dyes according to the present invention (and other sensitizing dyes and supersensitizers) to the silver halide emulsion according to the present invention may be at any stage of the preparation of the emulsion recognized as useful hitherto. For example, they may be added at any stage if it is before coating, i.e., before grain formation stage of silver halide grains or/and before desalting stage, during desalting stage and/or after desalting and before beginning of chemical ripening, as disclosed in U.S. Pat. Nos. 2,735,766, 3,628,960, 4,183,756, 4,225,666, JP-A-58-184142 and JP-A-60-196749, or just before or during chemical ripening, after chemical ripening and before coating as disclosed in JP-A-58-113920. Further, as disclosed in U.S. Pat. Nos. 4,225,666 and JP-A-58-7629, the sensitizing dyes can be used as a single compound alone or in combination with compounds having different structures, and they can be divided and added separately, for example, one part of them is added during grain formation stage and the remaining is added during chemical ripening or after the completion of chemical ripening, alternatively one part is added prior to chemical ripening or during chemical ripening stage and the remaining after completion of chemical ripening. The kinds of compounds added separately and combinations of compounds may be varied.

The addition amount of the sensitizing dyes according to the present invention (and other sensitizing dyes and supersensitizers) is varied in accordance with the figure and the size of silver halide grains, but the dyes can be used in an amount of from $1\times10^{-6}$ to $8\times10^{-3}$ mol per mol of the silver halide. For example, when the grain size of the silver halide grains is from 0.2 to 1.3 $\mu$m, the addition amount is preferably from $2\times10^{-6}$ to $3.5\times10^{-3}$ mol, and more preferably from $7.5\times10^{-6}$ to $1.5\times10^{-3}$ mol per mol of the silver halide.

However, when the sensitizing dyes according to the present invention are multilayer-adsorbed as described above, necessary amounts for multilayer-adsorption are added.

The sensitizing dyes according to the present invention (and other sensitizing dyes and supersensitizers) can be directly dispersed in an emulsion. Alternatively, the sensitizing dyes may be dissolved in an appropriate solvent, e.g., methylalcohol, ethyl alcohol, methyl Cellosolve, acetone, water, pyridine, or mixtures of these solvents, and added to an emulsion as a solution. At this time, additives such as bases, acids, surfactants and the like can be added together. Further, ultrasonic waves can also be used for dissolution. For adding the sensitizing dyes, a method of dissolving the sensitizing dyes in a volatile organic solvent, dispersing the solution in a hydrophilic colloid and adding this dispersion to an emulsion as disclosed in U.S. Pat. No. 3,469,987, a method of dispersing the sensitizing dyes in a water-soluble solvent and adding the dispersion to an emulsion as disclosed in JP-B-46-24185, a method of dissolving the sensitizing dyes in a surfactant and adding the solution to an emulsion as disclosed in U.S. Pat. No. 3,822,135, a method of dissolving the sensitizing dyes using a compound capable of red-shifting and adding the solution to an emulsion as disclosed in JP-A-51-74624, and a method of dissolving the sensitizing dyes in an acid not substantially containing water and adding the solution to an emulsion as disclosed in JP-A-50-80826 can be used. Besides these methods, the methods disclosed in U.S. Pat. Nos. 2,912,343, 3,342,605, 2,996,287 and 3,429,835 can also be used for the addition of the sensitizing dyes to an emulsion.

An antifoggant, a stabilizer and a nucleating agent can be exemplified as silver halide adsorptive compounds (photographically useful compounds adsorbable onto a silver halide grain) other than a sensitizing dye in the present invention. As to antifoggants and stabilizers, the compounds described in *Research Disclosure*, Vol. 176, Item 17643 (RD 17643), ibid., Vol. 187, Item 18716 (RD 18716), and ibid., Vol. 308, Item 308119 (RD 308119) can be used. As to nucleating agents, the hydrazines disclosed in U.S. Pat. Nos. 2,563,785 and 2,588,982, the hydrazides and hydrazones disclosed in U.S. Pat. No. 3,227,552, the heterocyclic quaternary salt compounds disclosed in British Patent 1,283,835, JP-A-52-69613, JP-A-55-138742, JP-A-60-11837, JP-A-62-210451, JP-A-62-291637, U.S. Pat. Nos. 3,615,515, 3,719,494, 3,734,738, 4,094,683, 4,115,112, 4,306,016 and 4,471,044, the sensitizing dye shaving a substituent having a nucleating function in the dye molecules disclosed in U.S. Pat. No. 3,718,470, the thiourea-combined acylhydrazine-based compounds disclosed in U.S. Pat. Nos. 4,030,925, 4,031,127, 4,245,037, 4,255,511, 4,266,013, 4,276,364, and British Patent 2,012,443, and the acylhydrazine-based compounds bonded with a thioamide ring and a heterocyclic group, e.g., triazole or tetrazole, as the adsorption group disclosed in U.S. Pat. Nos. 4,080,270, 4,278,748 and British Patent 2,011,391B are used.

Any of silver bromide, silver iodobromide, silver chlorobromide, silver iodide, silver iodochloride, silver iodobromochloride and silver chloride can be used in the present invention as the silver halide in a photographic emulsion relating to the mechanism of light sensitivity. The average iodide content in the basement of the emulsion is from 0 to 30 mol %, preferably from 5 to 25 mol %, and more preferably from 7 to 20 mol %, based on the silver amount in the basement.

The basement of a silver halide grain maybe a core/shell structure, if necessary. In this case, the core part of the basement preferably accounts for from 50% to 70% of the silver amount in the basement, and the average iodide content of the core part is from 0 to 30 mol %, preferably from 5 to 25 mol %, and more preferably from 7 to 20 mol %. The iodide content of the shell part is preferably from 0 to 3 mol %.

The grain size distribution may be broad or narrow but is preferably narrow.

The silver halide grains contained in a photographic emulsion may have a regular crystal form, such as cubic, octahedral, tetradecahedral, or rhombic dodecahedral, an irregular crystal form, such as spherical or plate-like, the hkl planes, or a composite form of these crystal forms, but the silver halide grains according to the present invention are preferably tabular grains. Tabular grains are described in detail below. With respect to the silver halide grains having higher order planes, *Journal of Imaging Science*, Vol. 30, pp. 247 to 254 (1986) can be referred to.

The above-described silver halide grains may be used in the silver halide photographic emulsion according to the present invention alone or in combination of two or more. The interior and the surface of the silver halide grain may be composed of different phases, the silver halide grain may be composed of multi-phase structures having junction structures, may have a local phase on the surface, or the grain may be composed of uniform phase. The grains may be composed of the mixture of these grains.

The emulsions may be of the surface latent image type wherein the latent image is mainly formed on the surface, or of the internal latent image type wherein the latent image is formed within the grains.

Tabular silver halide grains having halogen composition comprising silver chloride, silver bromide, silver chlorobromide, silver iodobromide, silver chloroiodobromide or silver iodochloride are preferably used in the present invention. The tabular grains having {100} or {111} main surfaces are preferably used. Tabular grains having {111} main surfaces (hereinafter referred to as {111} tabular grains) have generally triangular or hexagonal planes. In general, the more uniform the grain size distribution, the higher is the ratio of tabular grains having hexagonal planes. Hexagonal monodispersed tabular grains are disclosed in JP-B-5-61205.

Tabular grains having {100} main surfaces (hereinafter referred to as {100} tabular grains) have rectangular or square figures. In this emulsion, from acicular grains to grains having a ratio of adjacent side lengths of less than 5/1 are called tabular grains. In silver chloride tabular grains or high silver chloride content tabular grains, {100} tabular grains are originally high in main surface stability as compared with {111} tabular grains. With {111} tabular grains, it is essential to stabilize {111} main surface, and JP-A-9-80660, JP-A-9-80656 and U.S. Pat. No. 5,298,388 can be referred to with respect to the methods of stabilizing main surface.

Silver chloride {111} tabular grains or high silver chloride content {111} tabular grains for use in the present invention are disclosed in U.S. Pat. Nos. 4,414,306, 4,400,463, 4,713,323, 4,783,398, 4,962,491, 4,983,508, 4,804,621, 5,389,509, 5,217,858 and 5,460,934.

High silver bromide content {111} tabular grains which are used in the present invention are disclosed in U. S. Pat. Nos. 4,425,425, 4,425,426, 443,426, 4,439,520, 4,414,310, 4,433,048, 4,647,528, 4,665,012, 4,672,027, 4,678,745, 4,684,607, 4,593,964, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

{100} Tabular grains for use in the present invention are disclosed in U.S. Pat. Nos. 4,386,156, 5,275,930, 5,292,632, 5,314,798, 5,320,938, 5,319,635, 5,356,764, European Patents 569971, 737887, JP-A-6-308648 and JP-A-9-5911.

The silver halide emulsions for use in the present invention are preferably tabular silver halide grains adsorbed with the sensitizing dyes of the present invention having higher surface area/volume ratio. The thickness of the tabular grain is preferably 0.07 $\mu$m or more and less than 0.7 $\mu$m, more preferably 0.07 $\mu$m or more and less than 0.6 $\mu$m, and still preferably 0.07 $\mu$m or more and less than 0.5 $\mu$m.

It is preferred that the dislocation lines of the tabular grains according to the present invention be uniformly distributed among grains. In the emulsion of the present invention, it is preferred that the silver halide grain having ten or more dislocation lines per one grain accounts for 50 to 100% (number) of the entire grains, more preferably from 70 to 100%, and particularly preferably from 90 to 100%.

If the percentage is less than 50%, it is not preferred in view of the uniformity among grains.

For finding the ratio of the grains having dislocation lines and the number of dislocation lines, it is preferred to directly observe at least 100 grains, more preferably 200 grains or more, and particularly preferably 300 grains or more.

It is preferred according to purpose that the salts of metal ions are added to the emulsion for use in the present invention during the preparation of the emulsion, e.g., in the step of grain formation, the step of desalting, the step of chemical sensitization or before coating. When grains are doped, metal ion salts are preferably added during grain formation, and when the surfaces of grains are modified or when metal ion salts are used as the chemical sensitizers, dopants are preferably added after grain formation and before completion of chemical sensitization. A method of doping can be selected such that a grain is entirely doped, only a core part of the grain is doped, or only a shell part is doped.

The examples of the metals which can be used include, e.g., Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb and Bi. These metals can be added in the form of a salt capable of being dissolved at the time of grain formation, e.g., ammonium salt, acetate, nitrate, sulfate, phosphate, hydroxide, or a six-coordinated complex salt or a four-coordinated complex salt. Specifically, $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, $K_4Ru(CN)_6$ can be exemplified. The ligands of coordination compounds can be selected from among halo, aquo, cyano, cyanate, thiocyanate, nitrosyl, thionitrosyl, oxo and carbonyl. They may be comprised of only one kind of a metal compound or may be comprised of two, three or more metal compounds in combination.

Chemical sensitizing methods which can be preferably performed in the present invention are chalcogenide sensitization and noble metal sensitization alone or in combination, and these sensitizing methods can be performed using active gelatin as described in T. H. James, *The Theory of the Photographic Process*, 4th Ed., pp. 67 to 76, Macmillan (1977), and also sensitization can be performed using sulfur, selenium, tellurium, gold, platinum, palladium, or iridium, or two or more of these sensitizers in combination at pAg of from 5 to 10, pH of from 5 to 8, and temperature of from 30 to 80° C. as described in *Research Disclosure*, Vol. 120 (April, 1974), No. 12008, idib., Vol. 134 (June, 1975), No. 13452, U.S. Pat. Nos. 2,642,361, 3,297,446, 3,772,031, 3,857,711, 3,901,714, 4,266,018, 3,904,415 and British Patent 1,315,755.

In noble metal sensitization, a noble metal salt such as gold, platinum, palladium and iridium can be used. In gold sensitization, well-known compounds such as chloroauric acid, potassium chloroaurate, potassium aurithiocyanate, gold sulfide and gold selenide can be used. A palladium compound means 2-equivalent or 4-equivalent salt of palladium. A preferred palladium compound is represented by $R_2PdX_6$ or $R_2PdX_4$, wherein R represents a hydrogen atom, an alkali metal atom or an ammonium group, and X represents a halogen atom, e.g., a chlorine, bromine or iodine atom.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferred. A gold compound and a palladium compound are preferably used in combination with thiocyanate or selenocyanate.

Hypo, thiourea-based compounds, rhodanine-based compounds, and the sulfur-containing compounds disclosed in U.S. Pat. Nos. 3,857,711, 4,266,018 and 4,054,457 can be used as sulfur sensitizers. Chemical sensitization can be performed in the presence of a so-called auxiliary chemical sensitizer. The compounds known to inhibit fogging during chemical sensitization and to increase sensitivity such as azaindene, azapyridazine, azapyrimidine are used as the useful auxiliary chemical sensitizer. The examples of auxiliary chemical sensitizer reformer are disclosed in U.S. Pat. Nos. 2,131,038, 3,411,914, 3,554,757, JP-A-58-126526 and G. F. Duffin, *Photographic Emulsion Chemistry*, pp. 138 to 143.

The emulsion according to the present invention is preferably subjected to gold sensitization in combination. The preferred amount of a gold sensitizer is from $1\times10^{-4}$ to $1\times10^{-7}$ mol, more preferably from $1\times10^{-5}$ to $5\times10^{-7}$ mol, per mol of the silver halide. The preferred amount of a palladium compound is from $1\times10^{-3}$ to $5\times10^{-7}$ mol per mol of the silver halide. The preferred amount of a thiocyan compound or a selenocyan compound is from $5\times10^{-2}$ to $1\times10^{-6}$ mol per mol of the silver halide.

The preferred amount of a sulfur sensitizer for use in the silver halide grains according to the present invention is from $1\times10^{-4}$ to $1\times10^{-7}$ mol, more preferably from $1\times10^{-5}$ to $5\times10^{-7}$ mol, per mol of the silver halide.

The emulsion of the present invention is preferably sensitized by a selenium sensitizing method. Well-known labile selenium compounds are used in selenium sensitization. Specifically, selenium compounds such as colloidal metal selenium, selenoureas (e.g., N,N-dimethylselenourea, N,N-diethylselenourea), seleno ketones and selenoamides can be used. Selenium sensitization is sometimes preferred to be used rather in combination with sulfur sensitization or noble metal sensitization or both of them.

The silver halide emulsion according to the present invention is preferably reduction sensitized during grain formation, after grain formation and before or during chemical sensitization, or after chemical sensitization.

The method of reduction sensitization can be selected from a method in which a reduction sensitizer is added to a silver halide emulsion, a method in which grains are grown or ripened in the atmosphere of low pAg of from 1 to 7 which is called silver ripening, or a method in which grains are grown or ripened in the atmosphere of high pH of from 8 to 11 which is called high pH ripening. Further, two or more of these methods can be used in combination.

A method of adding a reduction sensitizer is preferred from the point of capable of delicately controlling the level of reduction sensitization.

Stannous salt, ascorbic acid and derivatives thereof, amines and polyamines, hydrazine derivatives, formamidine-sulfinic acid, silane compounds and borane compounds are well known as reduction sensitizers. These well-known reduction sensitizers can be selectively used in the present invention, and two or more of these compounds can also be used in combination. Stannous chloride, thiourea dioxide, dimethylamine borane, ascorbic acid and derivatives thereof are preferred compounds as reduction sensitizers. Since the addition amount of a reduction sensitizer depends upon the production conditions of the emulsion, the addition amount needs to be selected, but from $10^{-7}$ to $10^{-3}$ mol per mol of the silver halide is preferred.

A reduction sensitizer is dissolved in water or an organic solvent, e.g., alcohols, glycols, ketones, esters or amides, and then added to a reaction solution during grain formation. A reduction sensitizer may be added to a reaction vessel in advance, but it is preferred to add it in the appropriate stage of grain growth. Alternatively, a reduction sensitizer may be put in a water-soluble silver salt aqueous solution or a water-soluble alkali halide aqueous solution in advance, and silver halide grains may be precipitated with these aqueous solutions. Moreover, the solution of a reduction sensitizer may be divided to several parts and added in several times or may be added continuously over a long period of time with the degree of the grain growth.

It is preferred to use an oxidizing agent for silver during the production process of the emulsion of the present invention. The oxidizing agent for silver is a compound having a function of acting on metal silver and converting it to a silver ion. In particular, a compound which can convert superminute silver grains by-produced in the course of the formation of silver halide grains and chemical sensitization to a silver ion is effective. The silver ion converted may form hardly water-soluble silver salt such as silver halide, silver sulfide or silver selenide, or may form easily water-soluble silver salt such as silver nitrate. The oxidizing agent for silver may be inorganic or organic. The examples of inorganic oxidizing agents include oxyacid salts, such as ozone, hydrogen peroxide and addition products thereof (e.g., $NaBO_2.H_2O_2.3H_20$, $2NaCO_3.3H_2O_2$, $Na_4P_2O_7.2H_2O_2$, $2Na_2SO_4.H_2O_2.2H_2O$), peroxy acid salt (e.g., $K_2S_2O_8$, $K_2C_2O_6$, $K_2P_2O_8$), peroxy complex compound (e.g., $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), permanganate (e.g., $KMnO_4$), and chromate (e.g., $K_2Cr_2O_7$), a halogen element such as iodine and bromine, perhalogen acid salt (e.g., potassium periodate), salt of metal of high valency (e.g., potassium hexacyano-ferrate (III)), and thiosulfonate.

Further, the examples of organic oxidizing agents include quinones such as p-quinone, organic peroxide such as peracetic acid and perbenzoic acid, compounds which release active halogen (e.g., N-bromosuccinimide, chloramine T, chloramine B).

The oxidizing agents which are preferably used in the present invention are inorganic oxidizing agents such as ozone, hydrogen peroxide and addition products thereof, a halogen element, thiosulfonate, and organic oxidizing agents such as quinones. It is preferred to use the above-described reduction sensitization in combination with oxidizing agents for silver. The method of usage can be selected from among a method in which an oxidizing agent is used and then reduction sensitization is performed, an inverse method thereof, and a method in which both are concurred with. These methods can be used selectively in grain forming process and chemical sensitization process.

Various compounds can be added to a photographic emulsion in the present invention for preventing generation of fog or stabilizing photographic performances during production, storage or processing of a photographic material. The examples of such compounds include silver halide-adsorptive compounds well-known as antifoggants or stabilizers such as thiazoles, e.g., benzothiazolium salt, nitroimidazoles, nitrobenzimidazoles, chlorobenzimidazoles, bromobenzimidazoles, mercaptothiazoles, mercaptobenzo-thiazoles, mercaptobenzimidazoles, mercaptothiadiazoles, aminotriazoles, benzotriazoles, nitrobenzotriazoles, mercaptotetrazoles (in particular, 1-phenyl-5-mercapto-tetrazole); mercaptopyrimidines; mercaptotriazines; thioketo compounds, e.g., oxazolinethione; azaindenes, e.g., triazaindenes, tetraazaindenes (in particular, 4-hydroxy-substituted-(1,3,3a,7)tetraazaindenes), and pentaazaindenes. For example, the compounds disclosed in U.S. Pat. Nos. 3,954,474, 3,982,947 and JP-B-52-28660 can be used. As one preferred compound, there is a compound as disclosed in JP-A-63-212932. Antifoggants and stabilizers can be used in various processing steps of emulsion production according to purpose, e.g., before grain formation, during grain formation, after grain formation, during washing, at the time of dispersion after washing, before chemical sensitization, during chemical sensitization, after chemical sensitization, and before coating. Antifoggants and stabilizers are added to a reaction solution during emulsion production to prevent fog from occurring and stabilize the emulsion, but they can be used for various other purposes besides these original functions, e.g., for controlling the crystal habit of a grain, for making a grain size small, for reducing the solubility of a grain, for controlling chemical sensitization, and for controlling the arrangement of dyes.

The light-sensitive material manufactured by using a silver halide emulsion obtained according to the present invention can comprise at least one layer of a blue-sensitive layer, a green-sensitive layer and a red-sensitive layer on a support, and the number and order of silver halide emulsion layers and light-insensitive layers are not particularly restricted. In a typical embodiment, the silver halide photographic material according to the present invention comprises at least one light-sensitive layer consisting of a plurality of silver halide emulsion layers having substantially the same color sensitivity but different degrees of light sensitivity on a support. The light-sensitive layer is a unit light-sensitive layer having a color sensitivity to any of blue light, green light and red light. In a multilayer silver halide color photographic material, the unit light-sensitive layers are generally arranged in the order of a red-sensitive layer, a green-sensitive layer and a blue-sensitive layer from the support side. However, the order of arrangement can be reversed depending on the purpose, alternatively, the unit light-sensitive layers may be arranged in such a way that a layer having a different light sensitivity is interposed between layers having the same color sensitivity.

The above-described various additives are used in the photographic material according to the present invention and various other additives can also be used according to purpose besides the above-described compounds.

These additives are described in detail in *Research Disclosure*, Item 17643 (December, 1978), ibid., Item 18716 (November, 1979) and ibid., Item 308119 (December, 1989). The locations corresponding thereto are indicated in the table below.

| Type of Additives | RD 17643 | RD 18716 | RD 308119 |
|---|---|---|---|
| 1. Chemical Sensitizers | page 23 | page 648, right column | page 996 |
| 2. Sensitivity Increasing Agents | — | page 648, right column | — |
| 3. Spectral Sensitizers and Supersensitizers | pages 23–24 | page 648, right column to page 649, right column | page 996, right column to page 998, right column |
| 4. Brightening Agents | page 24 | page 647, right column | page 998, right column |
| 5. Antifoggants and Stabilizers | pages 24–25 | page 649, right column | page 998, right column to page 1000, right column |
| 6. Light Absorbers, Filter Dyes, and Ultraviolet Absorbers | pages 25–26 | page 649, right column to page 650, left column | page 1003, left column to page 1003, right column |
| 7. Antistaining Agents | page 25, right column | page 650, left to right columns | page 1002, right column |
| 8. Color image Stabilizers | page 25 | — | page 1002, right column |
| 9. Hardening Agents | page 26 | page 651, left column | page 1004, right column to page 1005, left column |
| 10. Binders | page 26 | page 651, left column | page 1003, right column to page 1004, right column |
| 11. Plasticizers and Lubricants | page 27 | page 650, right column | page 1006, left to right columns |

-continued

| Type of Additives | RD 17643 | RD 18716 | RD 308119 |
|---|---|---|---|
| 12. Coating Aids and Surfactants | pages 26–27 | page 650, right column | page 1005, left column to page 1006, left column |
| 13. Antistatic Agents | page 27 | page 650, right column | page 1006, right column to page 1007, left column |
| 14. Matting Agents | — | — | page 1008, left column to page 1009, left column |

For preventing the deterioration of photographic performances due to formaldehyde gas, it is preferred to add to a photographic material the compounds disclosed in U.S. Pat. Nos. 4,411,987 and 4,435,503 capable of reacting with and fixing formaldehyde gas.

Various kinds of color couplers can be used in the present invention, and the specific examples of such color couplers are described in the patent specifications in the above *Research Disclosure*, No. 17643, VII-C to G, and ibid., No. 307105, VII-C to G.

As yellow couplers, those disclosed, e.g., in U.S. Pat. Nos. 3,933,501, 4,022,620, 4,326,024, 4,401,752, 4,248,961, JP-B-58-10739, British Patents 1,425,020, 1,476,760, U.S. Pat. Nos. 3,973,968, 4,314,023, 4,511,649, and EP-A-249473 are preferred.

As magenta couplers, 5-pyrazolone-based and pyrazoloazole-based compounds are preferred, and those disclosed in U.S. Pat. Nos. 4,310,619, 4,351,897, European Patent 73636, U.S. Pat. Nos. 3,061,432, 3,725,067, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, U.S. Pat. Nos. 4,500,630, 4,540,654, 4,556,630 and WO88/04795are particularly preferred.

As cyan couplers, phenol-based and naphthol-based couplers are exemplified, and those disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,011, 4,327,173, West German Patent (DT-OS) 3,329,729, EP-A-121365, EP-A-249453, U.S. Pat. Nos. 3,446,622, 4,333,999, 4,775,616, 4,451,559, 4,427,767, 4,690,889, 4,254,212, 4,296,199, and JP-A-61-42658 are preferred.

The typical examples of polymerized dye-forming couplers are disclosed in U.S. Pat. Nos. 3,451,820, 4,080,211, 4,367,282, 4,409,320, 4,576,910, British Patent 2,102,137 and EP-A-341188.

The present invention can be applied to various color photographic materials. For example, color negative films for general and cinema uses, color reversal films for slide and television, color paper, color positive film and color reversal paper are exemplified as representatives. The present invention can also be very preferably used in color dupe film.

The color photographic material according to the present invention can be development processed by ordinary methods as described in RD, No. 17643, pp. 28 to 29, ibid., No. 18716, p. 651, left to right column, and ibid., No. 307105, pp. 880 to 881.

The silver halide photographic material according to the present invention can also be applied to the photothermographic materials as disclosed in U.S. Pat. No. 4,500,626, JP-A-60-133449, JP-A-59-218443, JP-A-61-238056 and EP-A-210660.

The silver halide color photographic material according to the present invention can exhibit its effect more when applied to the film units with lenses as disclosed in JP-B-2-32615 and JP-B-U-3-39784 (the term "JP-B-U" as used herein means an "examined Japanese utility model publication"), so that effective.

EXAMPLE

The present invention will be described in detail below with reference to specific examples, but it should not be construed as being limited thereto.

Example 1

Preparation of Emulsion A

A potassiumbromide aqueous solution and a silver nitrate aqueous solution were added to a gelatin aqueous solution containing 0.1 g per mol of the silver of 3,4-dimethyl-1,3-thiazolin-2-one with vigorously stirring at 65° C. over 25 minutes. The addition of potassium bromide was started 10 seconds after the beginning of the addition of silver nitrate, and octahedral silver bromide grains having an average grain size of 0.23 $\mu$m were obtained. Sodium thiosulfate (8 mg) and 2 mg of chloroauric acid each per mol of the silver were added to this emulsion in order, and the mixed solution was heated at 65° C. for 50 minutes, thereby the emulsion was chemically sensitized. The thus-obtained grains as cores were further grown in the same precipitation condition as in the first time, and octahedral mono dispersed core/shell silver bromide Emulsion A having an average grain size of 0.5 $\mu$m was finally obtained.

Preparation of Emulsions 1-1 to 1-12

A solution obtained by dissolving comparative Dye H1, H2 each having the structure shown below, exemplified Linked Dye D-24, D-25, D-26, D-27, and D-28 each having the structure shown above, model dye in the first layer H3, H4, H5, H6 or H7 each having the structure shown below in methanol was added to Emulsion A in a dye amount of $7.6\times10^{-4}$ mol per mol of the silver, thus Emulsion 1-1, 1-2, 1-3, 1-4, 1-5, 1-6, 1-7, 1-8, 1-9, 1-10, 1-11 or 1-12 was obtained.

H1

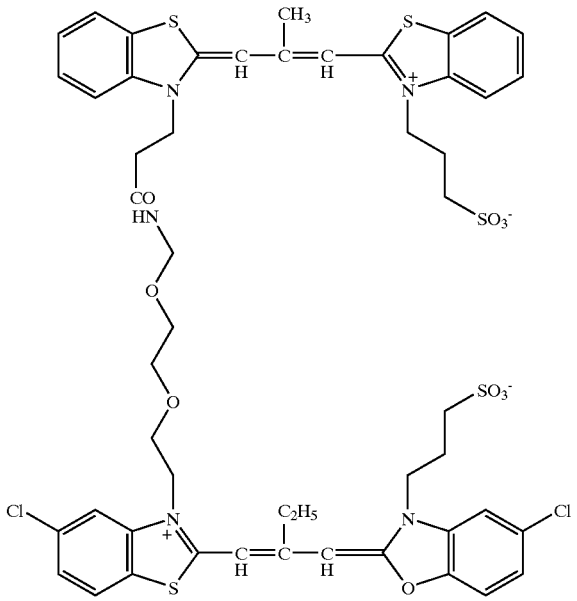

H2

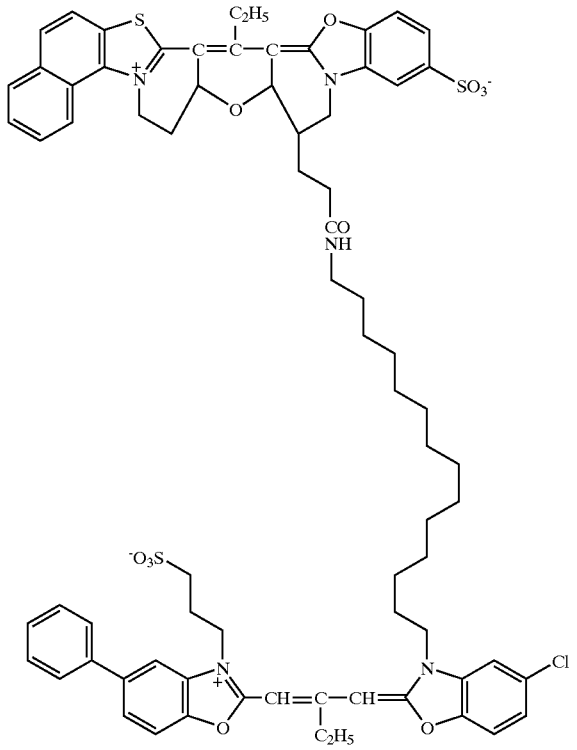

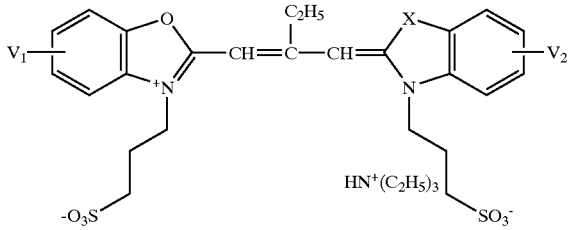

| | X | V1 | V2 | λmax |
|---|---|---|---|---|
| H3 | O | 5-Ph | 5-Ph | 548 |
| H4 | O | 5-Ph | 5-Cl | 553 |
| H5 | O | 4,5-benzo | 5-Cl | 560 |
| H6 | O | 4,5-benzo | 5,6-benzo | 574 |
| H7 | S | 5-Cl | 5-H | 586 |

Manufacture of Coated Sample

Emulsion 1-1, 1-2, 1-3, 1-4, 1-5, 1-6, 1-7, 1-8, 1-9, 1-10, 1-11 or 1-12 as a coating solution was coated on a cellulose triacetate film and dried, and the thus-obtained sample was named coated Sample 1-1, 1-2, 1-3, 1-4, 1-5, 1-6, 1-7, 1-8, 1-9, 1-10, 1-11 or 1-12.

Further, Comparative dye H8 or H9 each having the structure shown below was dissolved in a gelatin aqueous solution, and a gelatin hardening agent and a coating aid were added thereto. The thus-obtained coating solution was coated on a cellulose acetate film support in dye concentration of $10^{-4}$ mol/dm$^3$ simultaneously with a gelatin protective layer. The coated samples were named Samples 1–13 and 1–14. The thickness of the gelatin protective layer was 4.4 $\mu$m.

H8

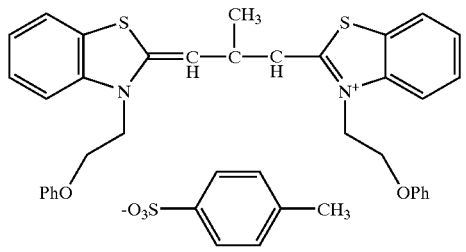

H9

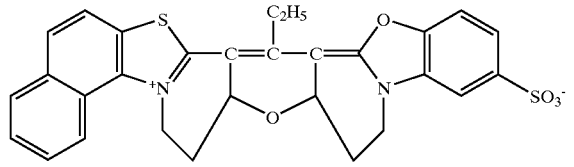

Measurement of Absorption and Fluorescence Spectrum

The absorption spectrum of each of Samples 1-1, 1-2, 1-3, 1-4, 1-5, 1-6, 1-7, 1-8, 1-9, 1-10, 1-11 and 1-12 was measured with a spectrophotometer model U3500 (manufactured by Hitachi, Ltd.) and the maximum absorption wavelength was obtained. Further, the fluorescence spectrum of each of Samples 1-13 and 1-14 was measured with a fluorophotometer model 850 (manufactured by Hitachi, Ltd.) and the maximum emission wavelength was obtained.

Velocity Constant of Radiation Deactivation of Dye in Second Layer

The velocity constant of radiation deactivation of the dye in the second layer of each sample was computed from the fluorescence quantum yield and fluorescence life time obtained by the following methods.

With Sample 1-13 or 1-14, the emission life of the dye contained in the second layer (H8 or H9) of each sample at the time of being excited by the maximum absorption wavelength was measured by the following method.

A femto-second laser (CPA-2000, manufactured by Clark-MXR Co., fundamental wave: 775 nm, pulse duration: 130–150 fs, repetition: 1 kHz) was subjected to incidence on an optical parametric amplifier (IR-OPA, manufactured by Clark-MXR Co., wavelength variable range: 300 nm to 2.5 μm), and the dye in the second layer contained in the sample was converted into the wavelength capable of excitation. The fluorescence from the sample was detected by a streak camera (Model C4334, manufactured by Hamamatsu Photonics Co., time resolution: 20 ps) attached to a spectroscope, and the time resolution fluorescence spectrum was measured. The measurement was performed by a single photon counting system and integration was performed 30,000 times. For preventing the break of dye due to excitation light, the coated sample was moved on an automatic X-Z stage, and the fluorescence life time was measured with moving excited spot ceaselessly. The moving velocity of the sample was 3 cm/sec.

With Samples 1-13 and 1-14, the quantum yield of emission was measured according to the method disclosed in JP-A-63-138341.

Evaluation of Coated Sample

For evaluating the sensitivity of coated Sample 1-1, 1-2, 1-3, 1-4, 1-5, 1-6 or 1-7, each sample was subjected to exposure for 1/60 sec. through an optical wedge and a gelatin filter (transmitting 500 nm or higher) by a Fuji Model FW sensitometer (manufactured by Fuji Photo Film Co., Ltd.), processed with a D-19 developing solution manufactured by Eastman Kodak Co. and density was measured. The reciprocal of the exposure amount giving density of fog+0.2 was taken as sensitivity, and the sensitivity of coated Sample 1-3, 1-4, 1-5, 1-6or 1-7 was shown as a relative value taking the sensitivity of Sample 1-1 as 100. The relative sensitivity of Sample 1-4 with the sensitivity of Sample 1-2 as 100 was also shown.

TABLE 1

| | | Physical Properties of the Dye in the Second Layer in Gelatin Dry Film | | | Dye in the First Layer | | |
|---|---|---|---|---|---|---|---|
| Example No. | Sample No. | No. of Gelatin Dry Film | Maximum Absorption Wavelength of Fluorescence of the Dye in the Second Layer (nm) | Velocity Constant of Radiation Deactivation ($10^8$ $sec^{-1}$) | No. of Dye in the First Layer | Maximum Absorption Wavelength of the Dye in the First Layer/nm (in emulsion) | Sensitivity |
| Comparative Example 1-1 | 1-1 | 1-13 | 567 | 0.0011 | 1-12 | 590 | 100 |
| Example 1-1 | 1-3 | 1-14 | 582 | 2.1 | 1-8 | 548 | 158 |
| Example 1-2 | 1-4 | 1-14 | 582 | 2.1 | 1-9 | 553 | 161 |
| Example 1-3 | 1-5 | 1-14 | 582 | 2.1 | 1-10 | 560 | 156 |
| Example 1-4 | 1-6 | 1-14 | 582 | 2.1 | 1-11 | 586 | 150 |
| Example 1-5 | 1-7 | 1-14 | 582 | 2.1 | 1-12 | 590 | 148 |
| Comparative Example 1-2 | 1-2 | 1-14 | 582 | 2.1 | 1-9 | 553 | 100 |
| Example 1-6 | 1-4 | 1-14 | 582 | 2.1 | 1-9 | 553 | 142 |

It can be seen from the results in Table 1 that sensitivity can be improved even when the difference between the maximum absorption wavelength of fluorescence of the dye in the second layer and maximum absorption wavelength of the dye in the first layer is great. Further, it can be seen that sensitivity is enhanced when the distance between the dye in the second layer and the dye in the first layer is short.

Example 2

Preparation of Seed Emulsion A

An aqueous solution (1,164 ml) containing 0.017 g of KBr and 0.4 g of oxidation-processed gelatin having an average molecular weight of 20,000 was stirred with maintaining the temperature at 35° C. An $AgNO_3$ aqueous solution (1.6 g), a KBr aqueous solution and 2.1 g of an aqueous solution containing oxidation-processed gelatin having an average molecular weight of 20,000 were added to the above aqueous solution by a triple jet method over 48 seconds. At this time, the silver potential was maintained at 13 mV to the saturated calomel electrode. A KBr aqueous solution was added to the reaction solution and the silver potential was adjusted to −66 mV, and then the temperature was raised to 60° C. After 21 g of succinated gelatin having an average molecular weight of 100,000 was added to the reaction solution, 5.1 g of an NaCl aqueous solution was added. An $AgNO_3$ aqueous solution (206.3 g) and a KBr aqueous solution were added thereto by a double jet method with accelerating the flow rate over 61 minutes. At this time, the silver potential was maintained at −44 mV to the saturated calomel electrode. After desalting the reaction solution, succinated gelatin having an average molecular weight of 100,000 was added to adjust pH to 5.8 and pAg to 8.8 at 40° C., thereby a seed emulsion was prepared. The seed emulsion was a tabular grain emulsion containing 1 mol of Ag and 80 g of gelatin per kg of the emulsion and having an average equivalent-circle diameter of 1.46 μm, an equivalent-circle variation coefficient of 28%, an average thickness of 0.046 μm, and an average aspect ratio of 32.

Formation of Core

An aqueous solution (1,200 ml) containing 134 g of Seed Emulsion a, 1.9 g of KBr and 22 g of succinated gelatin having an average molecular weight of 100,000 was stirred with maintaining the temperature at 75° C. An $AgNO_3$ aqueous solution (43.9 g), a KBr aqueous solution and an aqueous solution containing gelatin having a molecular weight of 20,000 were mixed just before addition in other chamber having a magnetic coupling induction type stirrer as disclosed in JP-A-10-43570, and the mixture was added to the above solution containing Seed Emulsion a over 25 minutes. At this time, the silver potential was maintained at −40 mV to the saturated calomel electrode.

Formation of First Core

After formation of the above core grains, 43.9 g of an $AgNO_3$ aqueous solution, a KBr aqueous solution and an aqueous solution containing gelatin having a molecular weight of 20,000 were mixed in other chamber of the same build just before addition, and the mixture was added to the above solution over 20 minutes. At this time, the silver potential was maintained at −40 mV to the saturated calomel electrode.

Formation of Second Core

After formation of the above first shells, 42.6 g of an $AgNO_3$ aqueous solution, a KBr aqueous solution and an aqueous solution containing gelatin having a molecular weight of 20,000 were mixed in other chamber of the same build just before addition, and the mixture was added to the above solution over 17 minutes. At this time, the silver potential was maintained at −20 mV to the saturated calomel electrode, and then the temperature was lowered to 55° C.

Formation of Third Core

After formation of the above second shells, the silver potential was adjusted to −55 mV, 7.1 g of an $AgNO_3$ aqueous solution, 6.9 g of a KI aqueous solution and an aqueous solution containing gelatin having a molecular weight of 20,000 were mixed in other chamber of the same build just before addition, and the mixture was added to the above solution over 5 minutes.

Formation of Fourth Core

After formation of the above third shells, 66.4 g of an $AgNO_3$ aqueous solution and a KBr aqueous solution were added to the above solution by a double jet method over 30 minutes at a constant flow rate. Potassium iridium hexachloride and yellow prussiate of potash were added en route. At this time, the silver potential was maintained at 30 mV to the saturated calomel electrode. The mixed reaction solution was washed with water in an ordinary method, and gelatin was added to adjust pH to 5.8 and pAg to 8.8 at 40° C. The thus-obtained emulsion was named Emulsion B. The emulsion was a tabular grain emulsion having an average equivalent-circle diameter of 3.3 μm, an equivalent-circle variation coefficient of 21%, an average thickness of 0.090 μm, and an average aspect ratio of 37. When the dye occupation area was taken as 80 Å$^2$, the saturation covering amount by one layer was $1.45\times10^{-3}$ mol/mol Ag.

Comparative Example 2-1

After the temperature of Emulsion B was raised to 56° C. and exemplified Dye D-1 was added in an amount of 1.2×10−3 mol/mol Ag, C-5having the structure shown below, potassium thiocyanate, chloroauric acid, sodium thiosulfate and N,N-dimethylselenourea were added, and Emulsion B was optimally chemically sensitized. D-1 was further added thereto in an amount of $2.5\times10^{-4}$ mol/mol Ag and the emulsion was stirred for 60 minutes, and then comparative Dyes H10 and H11 each having the structure shown below were added thereto in an amount of $1.0\times10^{-3}$ mol/mol Ag, and the emulsion was further stirred for 60 minutes.

C-5

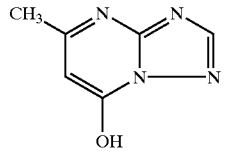

H10

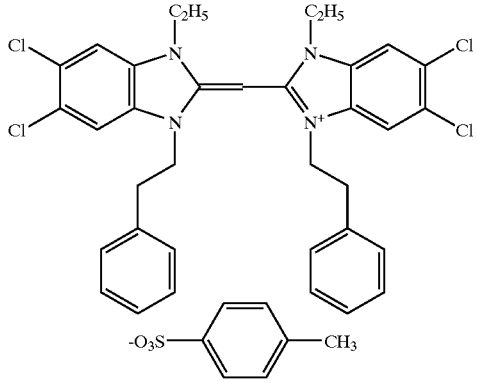

H11

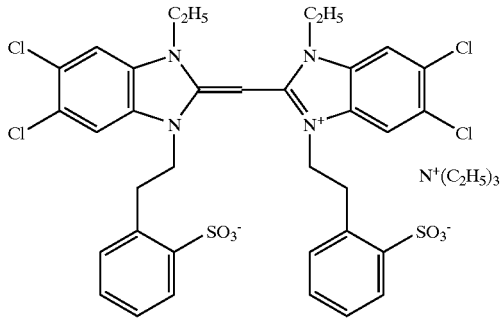

Example 2-1

After the temperature of Emulsion B was raised to 56° C. and D-1 was added in an amount of $1.2\times10^{-3}$ mol/mol Ag, C-5, potassium thiocyanate, chloroauric acid, sodium thiosulfate and N,N-dimethylselenourea were added, and Emulsion B was optimally chemically sensitized. D-1 was further added thereto in an amount of $2.5\times10^{-4}$ mol/mol Ag and the emulsion was stirred for 10 minutes, and then exemplified Dyes D-8 and D-10 were added thereto each in an amount of $1.0\times10^{-3}$ mol/mol Ag, and the emulsion was further stirred for 60 minutes.

Comparative Example 2-2

After the temperature of Emulsion B was raised to 56° C. and exemplified Dyes D-4 in an amount of $2.4\times10^{-4}$ mol/mol Ag and exemplified Dye D-5 in an amount of $9.6\times10^{-4}$ mol/mol Ag were added, C-5, potassium thiocyanate, chloroauric acid, sodium thiosulfate and N,N-dimethylselenourea were added, and Emulsion B was optimally chemically sensitized. D-4 was further added thereto in an amount of $2.5\times10^{-4}$ mol/mol Ag and the emulsion was stirred for 10 minutes, and then H8 and comparative Dye H12 having the structure shown below were added thereto in an amount of $1.0\times10^{-3}$ mol/mol Ag, and the emulsion was further stirred for 60 minutes.

H12

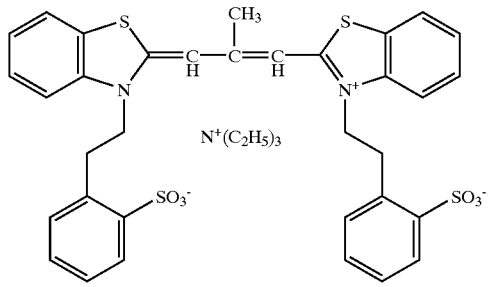

Example 2-2

After the temperature of Emulsion B was raised to 56° C. and D-4 in an amount of $2.4\times10^{-3}$ mol/mol Ag and D-5 in an amount of $9.6\times10^{-4}$ mol/mol Ag were added, C-5, potassium thiocyanate, chloroauric acid, sodium thiosulfate and N,N-dimethylselenourea were added, and Emulsion B was optimally chemically sensitized. D-4 was further added thereto in an amount of $2.5\times10^{-4}$ mol/mol Ag and the emulsion was stirred for 10 minutes, and then exemplified Dye D-13 was added thereto in an amount of $2.0\times10^{-3}$ mol/mol Ag, and the emulsion was further stirred for 60 minutes.

Comparative Example 2-3

After the temperature of Emulsion B was raised to 56° C. and comparative Dye H13 having the structure shown below was added in an amount of $1.2\times10^{-3}$ mol/mol Ag, C-5, potassium thiocyanate, chloroauric acid, sodium thiosulfate and N, N-dimethylselenourea were added, and Emulsion B was optimally chemically sensitized. H13 was further added thereto in an amount of $2.5\times10^{-4}$ mol/mol Ag and the emulsion was stirred for 30 minutes.

H13

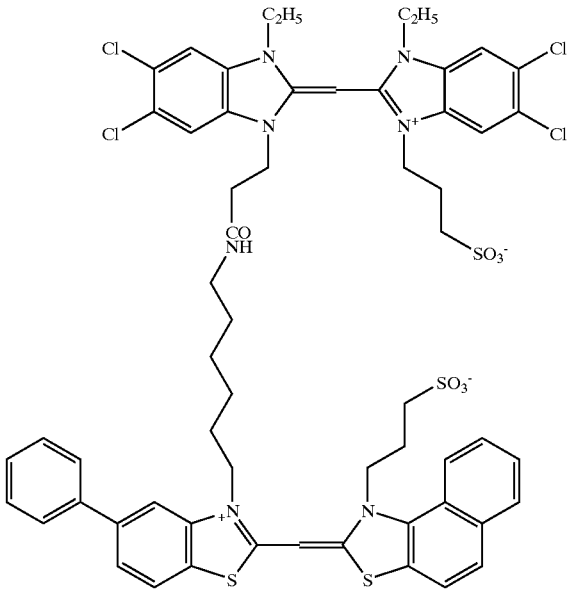

Example 2-3

After the temperature of Emulsion B was raised to 56° C. and exemplified Dye D-23 was added in an amount of $1.2\times10^{-3}$ mol/mol Ag, C-5, potassium thiocyanate, chloroauric acid, sodium thiosulfate and N,N-dimethylselenourea were added, and Emulsion B was optimally chemically sensitized. D-23 was further added thereto in an amount of $2.5\times10^{-4}$ mol/mol Ag and the emulsion was stirred for 30 minutes.

Example 2-4

Emulsion B was chemically sensitized in the same manner as in Example 2-3 except for using exemplified Dye D-19 in place of D-23.

Comparative Example 2-4

Emulsion B was chemically sensitized in the same manner as in Comparative Example 2-3 except for using H1 in place of H23.

Example 2-5

Emulsion B was chemically sensitized in the same manner as in Example 2-3 except for using exemplified Dye D-29 in place of D-23.

The sensitizing dye was used as a solid fine particle dispersion prepared by the method disclosed in JP-A-11-52507. That is, the solid fine particle dispersion of the sensitizing dye was obtained by dissolving 0.8 mass parts of sodium nitrate and 3.2 mass parts of sodium sulfate in 43 parts of ion exchange water, adding 13 mass parts of the sensitizing dye thereto, and dispersing the reaction system with dissolver blades at 60° C. for 20 minutes.

A gelatin hardening agent and a coating aid were added to each emulsion in Comparative Example 2-1 and Example 2-1, and each coating solution was coated on a cellulose acetate film support in a silver coating amount of 3.0 g/m$^2$ simultaneously with a gelatin protective layer. The coated samples were named Samples 2-1 and 2-2 respectively. Samples were prepared by replacing the emulsion in Sample 2-1 with the emulsion in Comparative Example 2-2, Example 2-2, Comparative Example 2-3, Example 2-3, Example 2-4, Comparative Example 2-4, or Example 2-5, and the obtained samples were named Sample 2-3, 2-4, 2-5, 2-6, 2-7, 2-8 and 2-9.

Further, H10, D-8, H8, D-13 or D-3 was dissolved in a gelatin aqueous solution, and a gelatin hardening agent and a coating aid were added thereto. The thus-obtained coating solution was coated on a cellulose acetate film support in dye concentration of $10^{-4}$ mol/dm$^3$ simultaneously with a gelatin protective layer. The thus-obtained coated samples were named Samples 2-10, 2-11, 2-12, 2-13 and 2-14. The thickness of the gelatin protective layer was 4.4 $\mu$m.

With Samples 2-1 to 2-14, the emission life of each of the dyes contained in the second layer (H10, D-8, H12, D-13 or D-3) of each sample at the time of being excited by the maximum absorption wavelength was measured by the following method.

A femto-second laser (CPA-2000, manufactured by Clark-MXR Co., fundamental wave: 775 nm, pulse duration: 130–150 fs, repetition: 1 kHz) was subjected to incidence on an optical parametric amplifier (IR-OPA, manufactured by Clark-MXR Co., wavelength variable range: 300 nm to 2.5 $\mu$m), and the dye in the second layer contained in the sample was converted into the wavelength capable of excitation. The fluorescence from the sample was detected by a streak camera (Model C4334, manufactured by Hamamatsu Photonics Co., time resolution: 20 ps) attached to a spectroscope, and the time resolution fluorescence spectrum was measured. The measurement was performed by a single photon counting system and integration was performed 30,000 times. For preventing the break of dye due to excitation light, the coated sample was moved on an automatic X-Z stage, and the fluorescence life time was measured with moving excited spot ceaselessly. The moving velocity of the sample was 3 cm/sec.

With Samples 2-10, 2-11, 2-12, 2-13 and 2-14, the quantum yield of emission was measured according to the method disclosed in JP-A-63-138341.

Each of the obtained samples was subjected to exposure with a tungsten lamp (color temperature: 2,854° K) through a continuous wedge color filter for 1 second.

Light of 390 nm or less was shielded using a Fuji gelatin filter SC-39 (manufactured by Fuji Photo Film Co., Ltd.) as the color filter, and Samples 2-1, 2-2, 2-5, 2-6 and 2-7 were subjected to exposure.

Light of 500 nm or less was shielded using a Fuji gelatin filter SC-50 for minus blue exposure which excites dyes (manufactured by Fuji Photo Film Co., Ltd.) as the color filter, and Samples 2-3, 2-4, 2-8 and 2-9 were subjected to exposure.

Each exposed sample was subjected to development by the following surface developing solution MAA-1 at 20° C. for 10 minutes.

| Composition of Surface Developing Solution MAA-1 | |
|---|---|
| Metol | 2.5 g |
| L-Ascorbic acid | 10 g |
| Nabox (manufactured by Fuji Photo Film Co., Ltd.) | 35 g |
| Potassium bromide | 1 g |
| Water to make | 1 liter |
| pH | 9.8 |

After development, each sample was subjected to fixing by the following fixing solution at 20° C.

| Composition of Fixing Solution | |
|---|---|
| Ammonium thiosulfate | 170 g |
| Sodium sulfite (anhydride) | 15 g |
| Boric acid | 7 g |
| Glacial acetic acid | 15 ml |
| Potassium alum | 20 g |
| Ethylenediaminetetraacetic acid | 0.1 g |
| Tartaric acid | 3.5 g |
| Water to make | 1 liter |

The optical density of each processed sample film was measured with a Fuji automatic densitometer. The reciprocal of the exposure amount required to give optical density of fog+0.2 was taken as sensitivity, and the sensitivity of each sample was shown as a relative value with the sensitivity of each comparative sample as 100.

The results obtained are shown in Table 2 below. It is apparent from the results that in the multilayer adsorption system, the greater the velocity constant of radiation deactivation, the more increased is the energy transfer efficiency from the second layer to the first layer, so that further enhancement of sensitivity can be realized as compared with conventional multilayer adsorption systems. It is also found that the effect of sensitivity enhancement is greater when linked dyes are used as compared with the system of using multilayer adsorption of sensitizing dyes.

TABLE 2

| Example No. | Sample No. | Dye in the First Layer or Linked Dye | Dye in the Second Layer | Emission Life in Coated Sample of Multilayer Absorption System (ns) | Physical Properties of the Dye in the Second Layer in Gelatin Dry Film: Sample No. of Gelatin Dry Film | Emission Life (ns) | Quantum Yield of Emission | Velocity Constant of Radiation Deactivation ($10^8$ $sec^{-1}$) | Sensitivity[1)] |
|---|---|---|---|---|---|---|---|---|---|
| Comparative Example 2-1 | 2-1 | D-1 | H10/H11 | 1.2 | 2-10 | 0.95 | 0.0064 | 0.067 | 100 |
| Example 2-1 | 2-2 | D-1 | D-8/D-10 | 0.05 | 2-11 | 2.4 | 0.86 | 3.6 | 125 |
| Comparative Example 2-2 | 2-3 | D-4/D-5 | H8/H12 | 0.66 | 2-12 | 0.45 | 0.0011 | 0.024 | 100 |
| Example 2-2 | 2-4 | D-4/D-5 | D-13 | 0.04 | 2-13 | 2.5 | 0.74 | 2.9 | 131 |
| Comparative Example 2-3 | 2-5 | H13 | | 1.0 | 2-10 | 0.95 | 0.0064 | 0.067 | 100 |
| Example 2-3 | 2-6 | D-23 | | 0.03 | 2-11 | 2.4 | 0.86 | 3.6 | 148 |
| Example 2-4 | 2-7 | D-19 | | 0.02 | 2-14 | 0.82 | 0.77 | 9.4 | 177 |
| Comparative Example 2-4 | 2-8 | H1 | | 0.47 | 2-12 | 0.45 | 0.0011 | 0.024 | 100 |
| Example 2-5 | 2-9 | D-29 | | 0.01 | 2-13 | 2.5 | 0.74 | 2.9 | 155 |

[1)]The sensitivity of the sample in Example 2-1 was shown with the sensitivity in Comparative Example 2-1 as standard, that in Example 2-2 with Comparative Example 2-2, Examples 2-3 and 2-4 with Comparative Example 2-3, and Example 2-5 with Comparative Example 2-4, respectively.

Example 3 and Comparative Example 3-1

Sample 3-1 was prepared by replacing the sensitizing dyes in Emulsion A-8 in the 14th layer of Sample No. 108 in JP-A-2001-92057 (Japanese Patent Application No. 11-268662) with sensitizing dyes D-1, H10 and H11. The addition of the dyes was as follows. After D-1 was added in an amount of $4.50\times10^{-4}$ mol/mol Ag, C-5, potassium thiocyanate, chloroauric acid, sodium thiosulfate and N,N-dimethylselenourea were added and the emulsion was optimally chemically sensitized. D-1 was further added to the emulsion in an amount of $0.51\times10^{-4}$ mol/mol Ag and the emulsion was stirred for 10 minutes, and then H10 and H11 were added each in an amount of $5.01\times10^{-3}$ mol/mol Ag, and the emulsion was further stirred for 60 minutes.

Example 3-1

H10 and H11 in Comparative Example 3-1 were replaced with D-8 and D-10. The addition of the sensitizing dyes to the emulsion was performed in the same manner as in Comparative Example 3-1.

Comparative Example 3-2

Sample 3-3 was prepared by replacing the sensitizing dyes in Emulsion P in the 11th layer of Sample No. 108 in JP-A-2001-92057 with D-4, D-5, H12 and H8.

Example 3-2

Sample 3-4 was prepared by replacing the sensitizing dyes in Emulsion P in the 11th layer of Sample No. 108 in JP-A-2001-92057 with D-4, D-5 and D-13.

Comparative Example 3-3

Sample 3-5 was prepared by replacing the sensitizing dyes in Emulsion A in the 14th layer of Sample No. 108 in JP-A-2001-92057 with H13. The addition of the sensitizing dye to the emulsion was performed in the same manner as in Comparative Example 3-1.

Examples 3-3 and 3-4

Samples 3-6 and 3-7 were prepared by replacing H13 in Comparative Example 3-3 with D-23 or D-19. The addition of the sensitizing dye to the emulsion was performed in the same manner as in Comparative Example 3-1.

Comparative Example 3-4

Sample 3-8 was prepared by replacing the sensitizing dyes in Emulsion P in the 11th layer of Sample No. 108 in JP-A-2001-92057 with H1.

Example 3-5

Sample 3-9 was prepared by replacing the sensitizing dyes in Emulsion P in the 11th layer of Sample No. 108 in JP-A-2001-92057 with D-29.

The results of the evaluation of the thus-obtained samples performed in the same manner as in JP-A-2001-92057 are shown in Table 3 below. It is apparent from the results that in the multilayer adsorption system, the greater the velocity constant of radiation deactivation of the dye in the second layer as shown in Table 2, the more increased is the energy transfer efficiency from the second layer to the first layer, so that further enhancement of sensitivity can be realized as compared with conventional multilayer adsorption systems.

TABLE 3

| Example No. | Sample No. | Sensitivity[1)] (Fog + 0.2) |
|---|---|---|
| Comparative Example 3-1 | 3-1 | 100 |
| Invention 3-1 | 3-2 | 121 |
| Comparative Example 3-2 | 3-3 | 100 |
| Invention 3-2 | 3-4 | 128 |

TABLE 3-continued

| Example No. | Sample No. | Sensitivity[1)] (Fog + 0.2) |
|---|---|---|
| Comparative Example 3-3 | 3-5 | 100 |
| Invention 3-3 | 3-6 | 136 |
| Invention 3-4 | 3-7 | 157 |
| Comparative Example 3-4 | 3-8 | 100 |
| Invention 3-5 | 3-9 | 140 |

[1)]The sensitivity is the reciprocal of the exposure amount giving density of (fog + 0.2) of yellow or magenta coloring. The sensitivities of Samples 3-2 and 3-4 were the values when the sensitivities of Samples 3-1 and 3-3 were taken as 100, and the sensitivities of Samples 3-6 and 3-7 were the values when the sensitivities of Samples 3-5 and 3-9 were taken as 100.

EFFECT OF THE INVENTION

A highly sensitized silver halide photographic emulsion can be obtained by the multilayer adsorption of sensitizing dyes which are selected by reflecting the nature of excitation state (excitation life and the velocity constant of radiation deactivation) observed directly, or by using linked dyes. Further, it became apparent from the Examples of the present invention that the effect of improving sensitivity was greater when linked dyes were used as compared with the case of multilayer-adsorbing sensitizing dyes.

The entitle disclosure of each and every foreign patent application from which the benefit of foreign priority has been claimed in the present application is incorporated herein by reference, as if fully set forth herein.

While the invention has been described in detail and with reference to specific examples thereof, it will be apparent to one skilled in the art that various changes and modifications can be made therein without departing from the spirit and scope thereof.

What is claimed is:

1. A silver halide photographic material containing silver halide grains onto which a sensitizing dye in a first layer and a sensitizing dye or dyes in a second or after layers are multilayer-adsorbed, wherein the sensitizing dye or dyes in the second or after layers are represented by formulas (III) or (IV):

(III)

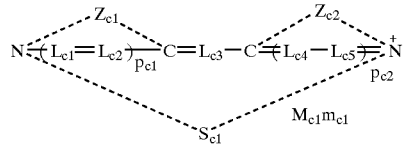

(IV)

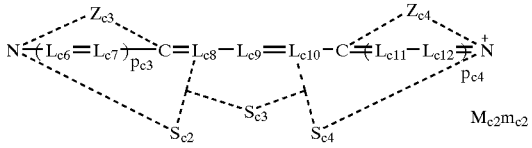

where in formula (III), $L_{c1}$, $L_{c2}$, $L_{c3}$, $L_{c4}$ and $L_{c5}$ each represents a methine group, $S_{c1}$ represents a linking group, $Z_{c1}$ and $Z_{c2}$ each represents an atomic group that forms a 5- or 6-membered nitrogen-containing heterocyclic ring, and $p_{c1}$ and $p_{c2}$ each represents 0 or 1, $M_{c1}$ represents a counter ion for equilibrating a charge, and $m_{c1}$ represents a number of from 0 to 10 to neutralize a charge in the molecule, and where in formula (IV), $L_{c6}$, $L_{c7}$, $L_{c8}$, $L_{c9}$, $L_{c10}$, $L_{c11}$ and $L_{c12}$ each represents a methine group, $S_{c2}$, $S_{c3}$ and $S_{c4}$ each represents a linking group, $Z_{c3}$ and $Z_{c4}$ each represents an atomic group that forms a 5- or 6-membered nitrogen-containing heterocyclic ring, and $p_{c3}$ and $p_{c4}$ each represents 0 or 1; $M_{c2}$ represents a counter ion for equilibrating a charge, and $m_{c2}$ represents a number of from 0 to 10 to neutralize a charge in the molecule, and wherein the fluorescence life time of the dye or dyes in the second or after layers on the silver halide grain surface measured at a maximum wavelength of fluorescence spectrum is shorter than the fluorescence life time of the dye or dyes in a gelatin dry film measured at a maximum wavelength of fluorescence spectrum.

2. A silver halide photographic material containing silver halide grains onto which a sensitizing dye in a first layer and a sensitizing dye or dyes in a second or after layers are multilayer-adsorbed, wherein the sensitizing dye or dyes in the second or after layers are represented by formulas (III) or (IV):

(III)

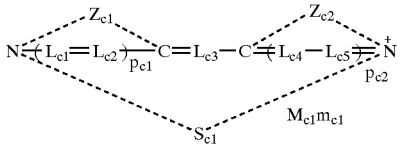

(IV)

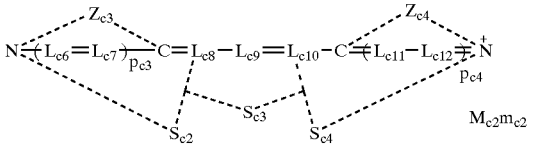

wherein formula (III), $L_{c1}$, $L_{c2}$, $L_{c3}$, $L_{c4}$ and $L_{c5}$ each represents a methine group, $S_{c1}$ represents a linking group, $Z_{c1}$ and $Z_{c2}$ each represents an atomic group that forms a 5- or 6-membered nitrogen-containing heterocyclic ring, and $p_{c1}$ and $p_{c2}$ each represents 0 or 1, $M_{c1}$ represents a counter ion for equilibrating a charge, and $m_{c1}$ represents a number of from 0 to 10 to neutralize a charge in the molecule, and where in formula (IV), $L_{c6}$, $L_{c7}$, $L_{c8}$, $L_{c9}$ $L_{c10}$, $L_{c11}$ and $L_{c12}$ each represents a methine group, $S_{c2}$, $S_{c3}$ and $S_{c4}$ each represents a linking group, $Z_{c3}$ and $Z_{c4}$ each represents an atomic group that forms a 5- or 6-membered nitrogen-containing heterocyclic ring, and $p_{c3}$ and $p_{c4}$ each represents 0 or 1; $M_{c2}$ represents a counter ion for equilibrating a charge, and $m_{c2}$ represents a number of from 0 to 10 to neutralize a charge in the molecule, and wherein the value obtained by dividing the fluorescence yield of the dye or dyes in the second or after layers measured in a gelatin dry film by the fluorescence life time of the dye or dyes measured in a gelatin dry film at a maximum wavelength of fluorescence spectrum (a velocity constant of radiation deactivation) is $10^7$ $sec^{-1}$ or higher.

3. The silver halide photographic material containing silver halide grains onto which sensitizing dyes are multilayer-adsorbed as claimed in claim 1, wherein the distance between the dye in the second layer and the dye in the first layer is 50 angstroms or less.

4. The silver halide photographic material as claimed in claim 1, wherein the excitation energy of the dye chromophores in the second or after layers of the silver halide grain transfers to the dye chromophore in the first layer in an efficiency of 10% or more.

5. The silver halide photographic material as claimed in claim 1, wherein the dye chromophore in the first layer and the dye chromophores in the second or after layers of the silver halide grains both show J-band absorption.

6. The silver halide photographic material as claimed in claim 1, wherein the dye in the first layer and the dyes in the second or after layers are connected by a covalent bond.

7. The silver halide photographic material as claimed in claim 6, wherein the covalent bond which connects the dyes in the second or after layers and the dye in the first layer is comprised of an organic bonding group containing one or more hetero atoms which are not a part of an amido group or an ester group.

8. The silver halide photographic material as claimed in claim 1, wherein the silver halide photographic emulsion in the photographic material is an emulsion wherein tabular grains having an aspect ratio of 2 or higher account for 50% or more of all area of the silver halide grains in the emulsion.

9. The silver halide photographic material as claimed in claim 1, wherein the silver halide photographic emulsion contained in the photographic material has been selenium-sensitized.

10. The silver halide photographic material as claimed in claim 1, wherein the silver halide grains in the silver halide photographic material contain a compound adsorptive onto silver halide other than the sensitizing dye.

11. The silver halide photographic material containing silver halide grains onto which sensitizing dyes are multilayer-adsorbed as claimed in claim 2, wherein the distance between the dye in the second layer and the dye in the first layer is 50 angstroms or less.

12. The silver halide photographic material as claimed in claim 2, wherein the excitation energy of the dye chromophores in the second or after layers of the silver halide grain transfers to the dye chromophore in the first layer in an efficiency of 10% or more.

13. The silver halide photographic material as claimed in claim 2, wherein the dye chromophore in the first layer and the dye chromophores in the second or after layers of the silver halide grains both show J-band absorption.

14. The silver halide photographic material as claimed in claim 2, wherein the dye in the first layer and the dyes in the second or after layers are connected by a covalent bond.

15. The silver halide photographic material as claimed in claim 14, wherein the covalent bond which connects the dyes in the second or after layers and the dye in the first layer is comprised of an organic bonding group containing one or more hetero atoms which are not a part of an amido group or an ester group.

16. The silver halide photographic material as claimed in claim 2, wherein the silver halide photographic emulsion in the photographic material is an emulsion wherein tabular grains having an aspect ratio of 2 or higher account for 50% or more of all area of the silver halide grains in the emulsion.

17. The silver halide photographic material as claimed in claim 2, wherein the silver halide photographic emulsion contained in the photographic material has been selenium-sensitized.

18. The silver halide photographic material as claimed in claim 2, wherein the silver halide grains in the silver halide photographic material contain a compound adsorptive onto silver halide other than the sensitizing dye.

* * * * *